US008827938B2

(12) United States Patent
Fukuyama

(10) Patent No.: US 8,827,938 B2
(45) Date of Patent: Sep. 9, 2014

(54) CHAIR TYPE MASSAGE MACHINE

(75) Inventor: Yoshifumi Fukuyama, Tottori (JP)

(73) Assignee: Family Inada Co., Ltd., Osaka (JP)

( * ) Notice: Subject to any disclaimer, the term of this patent is extended or adjusted under 35 U.S.C. 154(b) by 1014 days.

(21) Appl. No.: 12/923,636

(22) Filed: Sep. 30, 2010

(65) Prior Publication Data

US 2011/0077563 A1 Mar. 31, 2011

(30) Foreign Application Priority Data

Sep. 30, 2009 (JP) ..... 2009-227831

(51) Int. Cl.
*A61H 1/00* (2006.01)

(52) U.S. Cl.
CPC ..... *A61H 1/00* (2013.01); *A61H 2201/0149* (2013.01)
USPC ..... 601/99; 601/98; 601/102; 297/84

(58) Field of Classification Search
USPC ..... 601/23, 24, 46, 49, 52, 63, 84, 86, 87, 601/89, 90, 93, 94, 97, 98, 99, 101, 102, 601/107, 108, 111, 134; 297/83, 84, 180.12
See application file for complete search history.

(56) References Cited

U.S. PATENT DOCUMENTS

| | | | | |
|---|---|---|---|---|
| 3,548,810 | A * | 12/1970 | Hoyer et al. | 601/26 |
| 4,258,706 | A * | 3/1981 | Shank | 601/55 |
| 6,000,758 | A * | 12/1999 | Schaffner et al. | 297/84 |
| 6,695,799 | B2 * | 2/2004 | Kitadou et al. | 601/49 |
| 7,828,756 | B2 * | 11/2010 | Kamba et al. | 601/98 |
| 2012/0215143 | A1 * | 8/2012 | Inada et al. | 601/112 |

FOREIGN PATENT DOCUMENTS

| | | |
|---|---|---|
| JP | 2003-250851 A | 9/2003 |
| JP | 2004-41416 A | 2/2004 |

* cited by examiner

*Primary Examiner* — Quang D Thanh
(74) *Attorney, Agent, or Firm* — Rader, Fishman & Grauer PLLC

(57) ABSTRACT

A massage machine includes a seat portion, a backrest portion and a rocking mechanism center where the backrest portion reclines at a back portion side of the seat portion about a reclining center. The rocking mechanism portion swings the backrest portion and the seat portion about a rocking center, and the rocking center is apart or different from the reclining center.

5 Claims, 24 Drawing Sheets

CHAIR TYPE MASSAGE MACHINE

CROSS-REFERENCE TO RELATED APPLICATION

This application claims priority from Japanese Patent Application Serial No. 2009-227831 filed Sep. 30, 2009, the contents of which are incorporated herein by reference in their entirety.

TECHNICAL FIELD

The present invention relates to a massage machine.

BACKGROUND

A massage machine provided with a seat portion and a backrest portion with massage tools such as treatment elements, air cells, and the like provided therein is known. In such a chair type massage machine, the backrest portion can be reclined about a back portion side of the seat portion, as a reclining center. The chair type massage machine is configured to perform massage by keeping a user lying in a reclining state where the backrest portion is folded backward and by operating the massage tools.

In addition to the above massage machine with the massage tools, a chair type massage machine to provide a user with a relaxing effect, as disclosed in Japanese Patent Application Publication No. 2004-41416 (see, in particular, FIGS. 5 and 6), has become known in recent years.

This massage machine is configured such that the backrest portion can be rotated about the reclining center, and the seat portion can be swung vertically. This massage machine swings the body of the user sitting on its seat portion by vertically swinging the seat portion in a reciprocating manner and rotating the backrest portion about the reclining center in a reciprocating manner to provide the user with a relaxing effect.

Although it is possible to swing the body of the user by rotating the backrest portion about the reclining center in a reciprocating manner in the case of the chair type massage machine disclosed in Patent Document 1, this swinging operation causes the user's upper body to be folded and raised.

This operation is a repetition of the reclining operation of the backrest portion while the seat portion is moved vertically. Accordingly, the relaxing effect is considered to be insufficient.

SUMMARY OF THE INVENTION

A massage machine of the present invention that has a seat portion on which a user sits; a backrest portion in that massage tools for performing a massage operation are provided and which is capable of being reclined about a back portion side of the seat portion as a reclining center; and a rocking mechanism portion for swinging the backrest portion in a reclining state in the front-back direction along with the seat portion while taking a position, which is apart or different from the reclining center, as a rocking center.

DETAILED DESCRIPTION OF THE INVENTION

Figure 1:
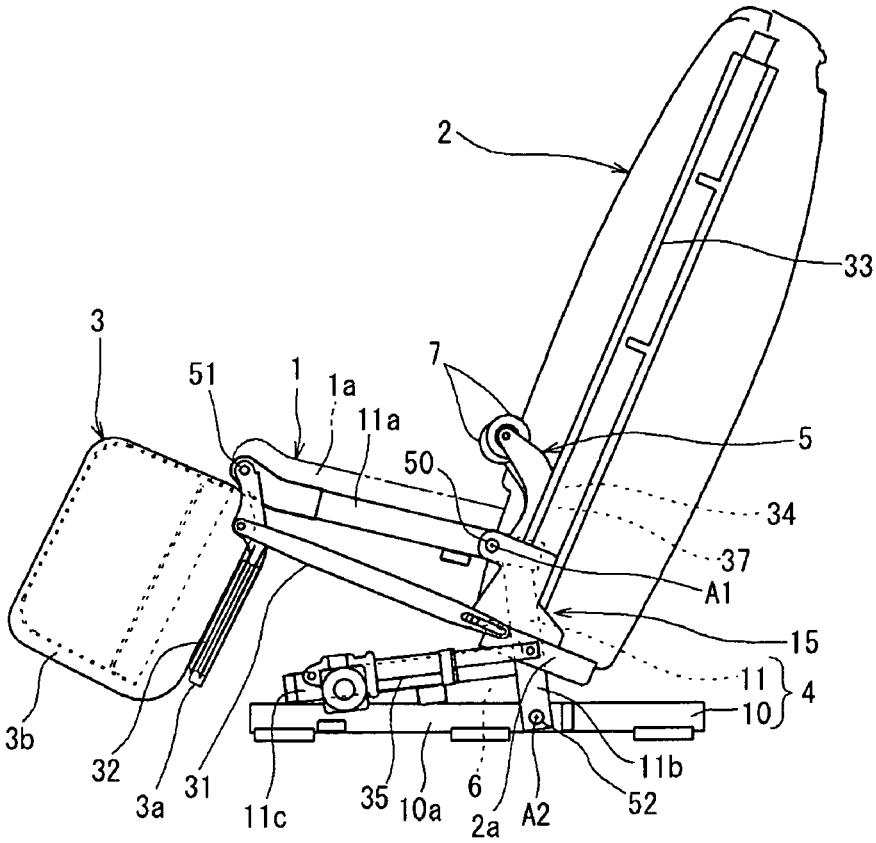
FIG. 1 is a side view illustrating a configuration of a massage machine according to the present invention.

According to the present invention, the backrest portion in the reclining state is swung in the front-back direction along with the seat portion while taking a position, which is apart or different from the reclining center, as a rocking center. Accordingly, it is possible to swing the user's body in the front-back direction by entirely swinging the seat portion and the backrest portion in the front-back direction in a different manner from that in the simple repetition of the reclining operation of the backrest portion, as in the case in the related art.

Furthermore, since the backrest portion is in the reclining state (in the state in which the backrest portion is maintained to be folded backward), it is possible to swing the user's body in the front-back direction while allowing the user's upper body to be folded backward and leaning against the backrest portion. As a result, it is possible to enhance the relaxing effect to be provided to the user, as compared with the case in the related art. In addition, the rocking center and the reclining center are not limited to fixed points on a straight line in the horizontal or vertical direction and may be points moving within a certain range. In such a case, the centers become spread-out regions.

In addition, it is preferable that the rocking mechanism portion includes a speed changing portion for gradually lowering a swinging speed as the seat portion and the backrest portion approach front and back track end portions while the seat portion and the backrest portion are swung in the front-back direction along a prescribed track in a reciprocating manner. Through such a change in the swinging speed, it is possible to provide the user with a more comfortable swinging feeling.

When the rocking mechanism portion includes a motor as a drive source for swinging the backrest portion and the seat portion, for example, the speed changing portion may be configured such that a control apparatus controls the revolution of the motor to gradually decrease the revolution, as the seat portion and the backrest portion approach the front and back track end portions. However, another configuration is also applicable in which the speed changing portion includes a decelerator whose output shaft is rotated at a constant speed by a constant rotation of a motor and a link portion that converts a rotation movement of the output shaft into a reciprocating movement of the seat portion and the backrest portion in the front-back direction and that changes a component of a movement speed of the reciprocating movement in the front-back direction.

In such a case, even when the rotation speed of the output shaft of the decelerator is constant, the link portion is caused to convert the rotation movement of the output shaft into the reciprocating movement of the seat portion and the backrest portion in the front-back direction and to change the component of the movement speed of the reciprocating movement in the front-back direction. That is, with the mechanical configuration including the decelerator and the link portion, it is possible to gradually lower the swinging speed, as the seat portion and the backrest portion approach the front and back track end portions.

For this reason, the configuration may be made such that the massage machine further has a fixed frame to be installed on a floor face; and a movable frame that supports the backrest portion and the seat portion and that moves in the front-back direction with respect to the fixed frame in a reciprocating manner. Further, such that the link portion includes a rotation member that an output shaft rotates, an eccentric shaft which is attached to the rotation member eccentrically with respect to the rotation center of the rotation member, and a crank member attached to the eccentric shaft and converts the movement of the eccentric shaft about the rotation center into the reciprocating movement of the movable frame in the front-back direction. The massage machine may also be constructed as a chair type massage machine, and the terms 'massage machine' and 'chair type massage machine' are used interchangeably without intent to limit any particular embodiment to only a chair type massage machine.

In addition, it is preferable that the chair type massage machine further includes a power transmission releasing portion that releases the transmission of a drive force, which is for swinging the backrest portion and the seat portion in the front-back direction, to the backrest portion and the seat portion when the operation of swinging the backrest portion and the seat portion in the front-back direction is interrupted.

In this case, if the swinging operation of the backrest portion and the seat portion is interrupted by contact with an obstacle during the swinging operation, the swinging drive force is not forcibly transmitted to the backrest portion and the seat portion. For this reason, it is possible to prevent a large load from acting on one or both of the sides of the backrest portion, the seat portion, and the side of the drive unit for swinging them, which may avoid malfunction.

When the backrest portion is swung forward along with the seat portion by the drive force of the drive unit, for example, a force to move further forward acts on the backrest portion and the seat portion due to the influence of the weight of the user thereon and the inertial force. However, a large load acts on the drive unit since the drive unit drives while receiving this force at this time.

For this reason, it is preferable that the rocking mechanism unit includes a drive unit for swinging the backrest portion in the front-back direction along with the seat portion, and a reaction member for causing a force in a direction in which the operation of swinging the backrest portion and the seat portion in the front-back direction is interrupted is further provided.

In such a case, it is possible to cause a force in a direction, in which the swinging operation is interrupted, by means of the reaction member and thereby to reduce the load to the drive unit.

According to the present invention, it is possible to swing the user's body in the front-back direction, and further to swing the user's body in the front-back direction while keeping the user's upper body folded backward and leaning against the backrest portion since the backrest portion is in the reclining state. As a result, it is possible to enhance the relaxing effect to be provided to the user.

Hereinafter, a description will be made of the embodiments of the present invention based on the accompanying drawings.

First Embodiment

FIG. 1 is a side view illustrating a configuration of a chair type massage machine according to the present invention. This chair type massage machine includes a frame 4 which is installed on the floor surface, a seat portion 1 which is provided in the frame 4 and on which a user (a treated person) is seated, a backrest portion 2 which is provided on the back side of the seat portion 1 and against which the user leans, and a leg-rest portion 3 which is provided on the front side of the seat portion 1 and on which the user puts his or her legs.

In the present invention, each direction is defined while taking the user as a reference such that the front side of the user sitting on the seat portion 1 is front and the back side of the user is back.

The frame 4 includes an unmovable fixed frame 10 which is installed on the floor surface and a movable frame 11 which can be moved in the front-back direction with respect to the fixed frame 10 in a reciprocating manner. The fixed frame 10 includes right and left foot portions 10*a* extending in the front-back direction. The movable frame 11 includes a first frame 11*a* to which the seat portion 1 is attached and a second frame 11*b* for connecting the first frame 11*a* and the fixed frame 10, which is longer in the vertical direction. The first frame 11*a* is fixed to the second frame 11*b*, both of which are integrally moved in the front-back direction in a reciprocating manner. The configuration for allowing the movable frame 11 to be moved will be described later.

Figure 2:
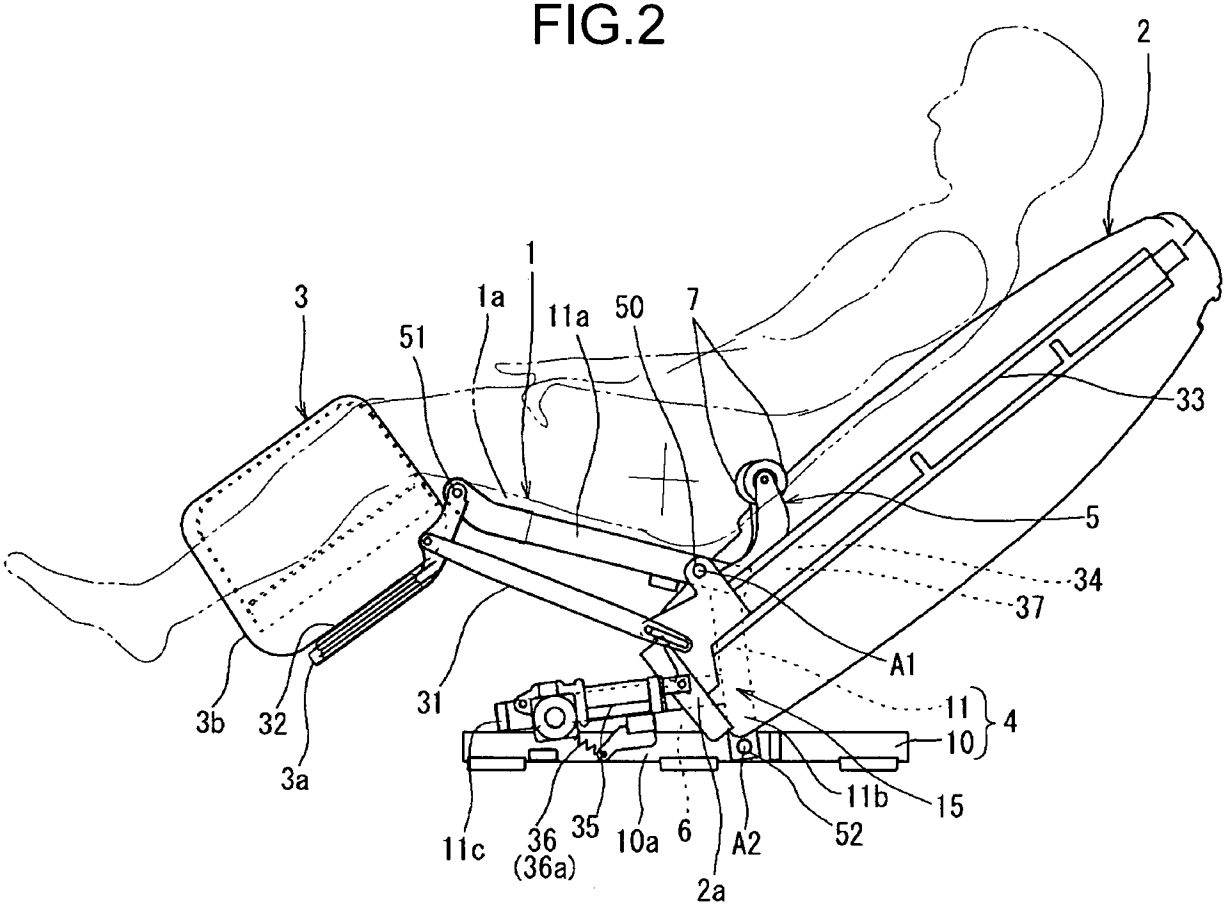
FIG. 2 is a side view of the massage machine in a reclining state.

The backrest portion 2 is attached to a support shaft 50 which is horizontally provided in the back portion of the movable frame 11 and can be rotated about the center line of the support shaft 50 with respect to the movable frame 11. That is, the backrest portion 2 can be reclined about the center of the support shaft 50, which corresponds to a supporting point on the back side of the seat portion 1, as a reclining center A1. With such a configuration, the backrest portion 2 can be in any one of a raised state in which the backrest portion 2 extends upward as shown in FIG. 1 and a state (a reclining state) in which the backrest portion 2 is folded backward as shown in FIG. 2, and further can be in a state in which the backrest portion 2 is in the intermediate position (not illustrated).

A massage unit 5 is provided in the backrest portion 2. The massage unit 5 is movable and guided along a guide rail 33 provided in the backrest portion 2, and can be moved in the longitudinal direction of the backrest portion 2 along the guide rail 33 by the operation of an elevating mechanism 34.

The massage unit 5 includes left and right treatment elements (kneading balls) 7 which can abut from the lower back to the mid-back and the shoulders of the user as massage tools for performing massage operations. It is possible to cause the treatment elements 7 to perform the operations such as kneading, tapping, and the like by driving a drive unit 37 which is mounted on the massage unit 5 and includes a motor, a decelerator, and a rotation shaft. By the operations of these treatment elements 7, the massage operations are implemented.

The leg-rest portion 3 is rotatably attached to the horizontal support shaft 51 positioned in the front portion of the movable frame 11, and can be rotated about the center line of the support shaft 51 with respect to the movable frame 11. Accordingly, the leg-rest portion 3 can be in any one of a lower position state in which the leg-rest portion 3 hangs downward from the front end of the movable frame 11 as shown in FIG. 1 and an upper position state in which the leg-rest portion 3 extends (inclines) forward from the front end of the frame 4 as shown in FIG. 2, and further can be a state in which the leg-rest portion 3 is in the intermediate position (not illustrated).

An interlocking member 31 which is long in the front-back direction is provided between the backrest portion 2 and the leg-rest portion 3. The leg-rest portion 3 is in the lower position state when the backrest portion 2 is in the raised state as shown in FIG. 1 while the leg-rest portion 3 is interlocked and turned to be in the upper position state by the interlocking member 31 when the backrest portion 2 is in the reclining state as shown in FIG. 2.

Figure 3:
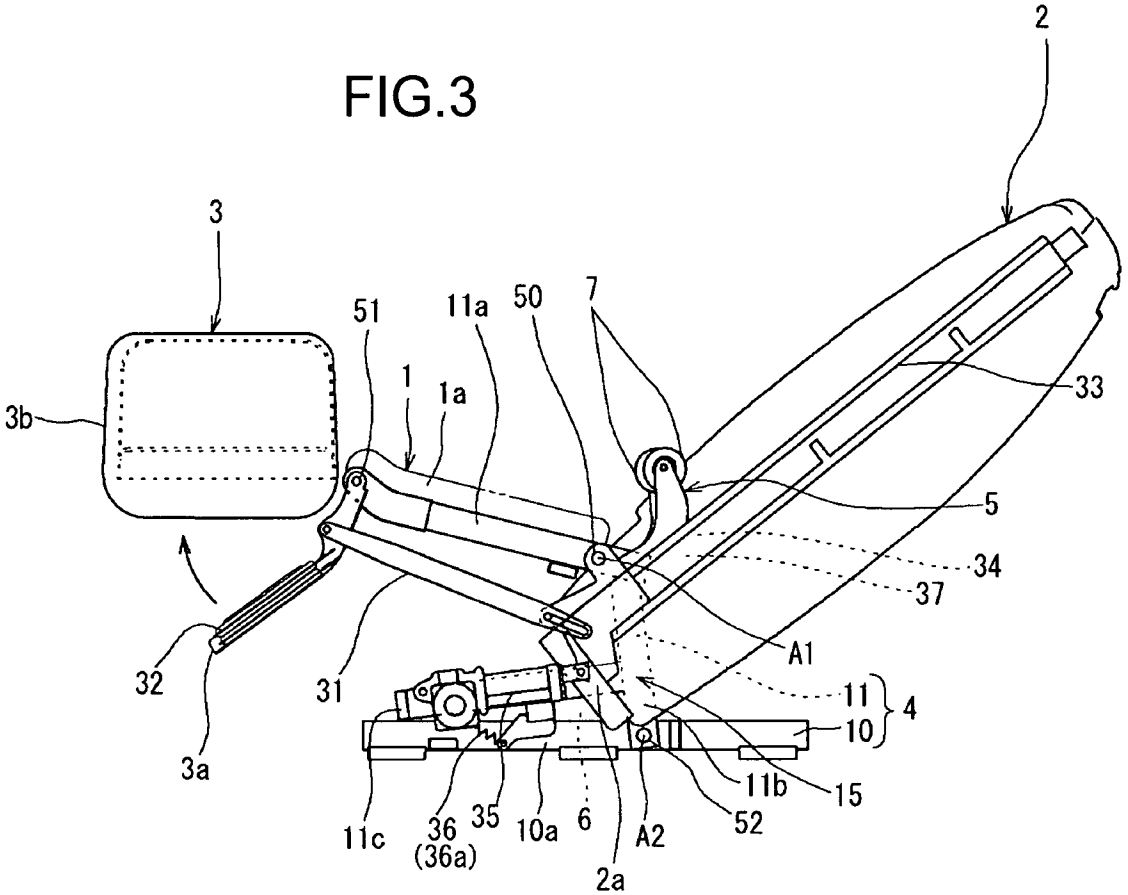
FIG. 3 is a side view of the massage machine whose leg-rest portion is moved further upward.

In addition, the leg-rest portion 3 includes a first frame portion 3*a* which is rotatably attached to the support shaft 51, a second frame portion 3*b* which is attached to the first frame portion 3*a* and rotatable about the horizontal center line, and a leg drive unit 32 provided between the first frame portion 3*a* and the second frame portion 3*b* as shown in FIG. 3. The leg drive unit 32 is constituted by air cells which expand or contract due to the supply and the discharge of air. When air is supplied from the air unit (not illustrated) provided in the frame 4 to the air cells, the air cells expand and lift the second frame portion 3*b*, and the second frame portion 3*b* can be moved further upward from the upper position state as shown in FIG. 3. In this state, the leg-rest portion 3 can support the legs of the user in a state in which the user stretches his or her legs.

A description will be made of the configuration for allowing the movable frame 11 to move in the front-back direction.

In FIGS. 1 and 2, the movable frame 11 (second frame 11*b*) is rotatably attached to a support shaft 52 which is horizontally provided at an intermediate position of the foot portion 10*a* of the fixed frame 10 in the front-back direction. Accordingly, the movable frame 11 can be rotated about the center line of the support shaft 52 with respect to the fixed frame 10.

That is, in this embodiment, the support shaft 52 (center line of this support shaft 52) functions as a rocking center A2, and the movable frame 11 can be rotated in the front-back direction in a reciprocating manner with respect to the fixed frame 10 while taking this rocking center A2 as a support point. In addition, the position of this rocking center A2 is apart from that of the reclining center A1 in the vertical direction.

The seat portion 1 includes a seat main portion 1*a* having a cushioning property, and this seat main portion 1*a* is attached onto the movable frame 11 (first frame 11*a*). Furthermore, the support shaft 50 as a support point of the backrest portion 2 is provided on the back side of the movable frame 11 (first frame 11*a*). Accordingly, the configuration is made such that the movable frame 11 supports the backrest portion 2 and the seat portion 1.

As described above, the movable frame 11 can be moved in the front-back direction in a reciprocating manner. As a result, it is possible to swing the seat portion 1 and the backrest portion 2 in the front-back direction.

The chair type massage machine of the present invention has a function of forcibly swinging the backrest portion 2, which is kept in the reclining state (see FIGS. 2 and 4), along with the seat portion 1 while taking the rocking center A2 as a support point. This operation of swinging in the front-back direction corresponds to the rocking operation.

Figure 4:
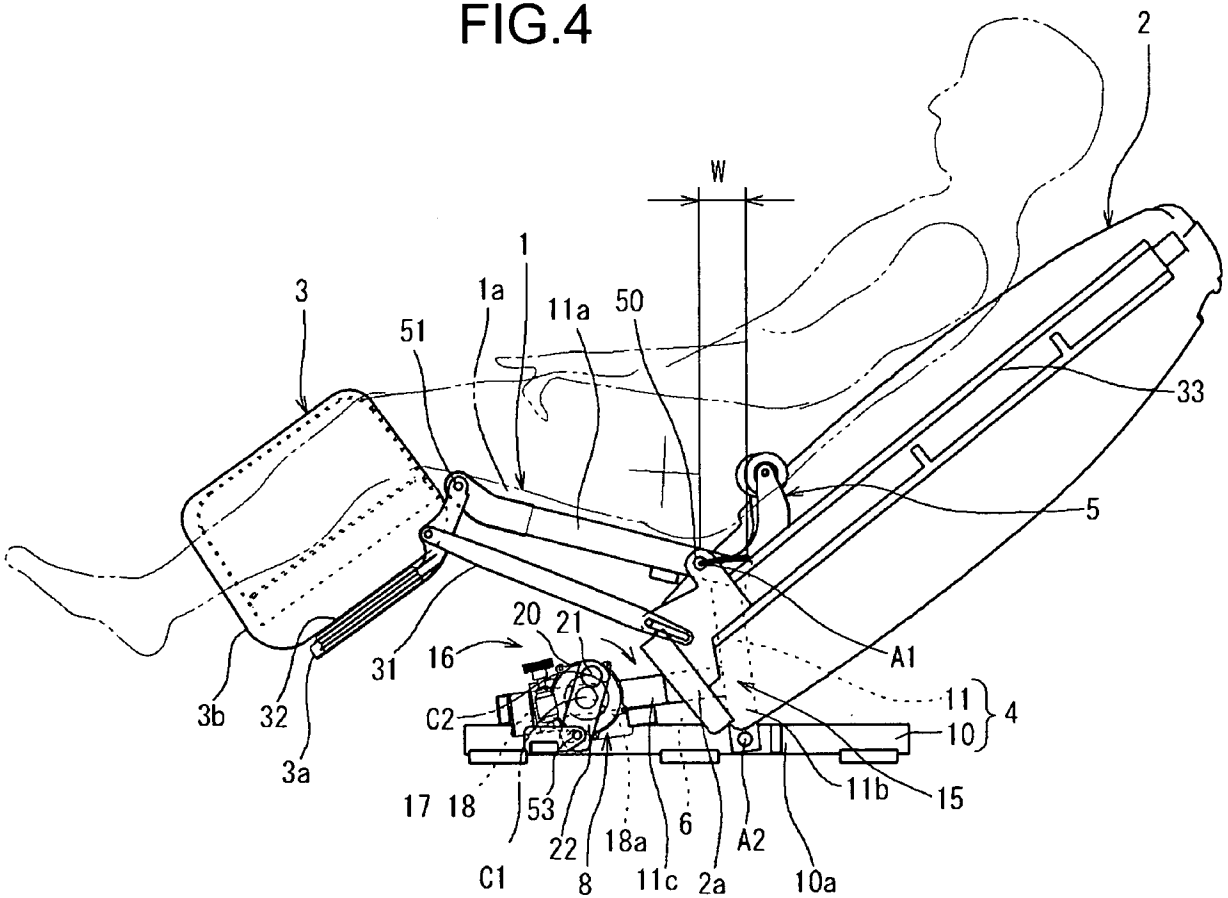
FIG. 4 is a side view of the massage machine for illustrating a rocking operation.
Figure 5:
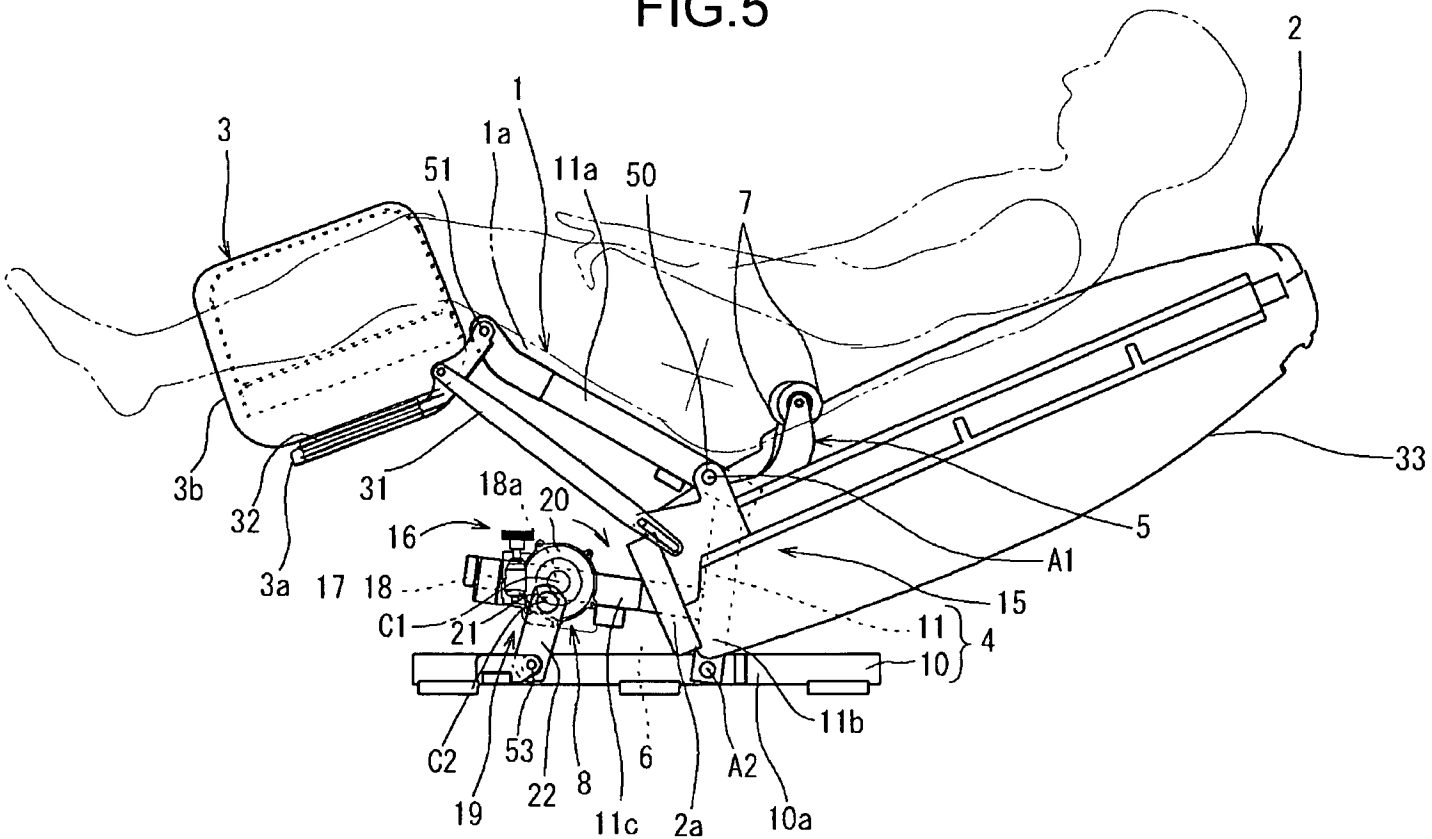
FIG. 5 is a side view of the massage machine for illustrating the rocking operation.

FIGS. 4 and 5 are side views for illustrating the rocking operation. FIG. 4 shows a front position state in which the backrest portion 2 and the seat portion 1 are swung to the front side, and FIG. 5 shows a back position state in which the backrest portion 2 and the seat portion 1 are swung to the back side. The chair type massage machine is provided with a rocking mechanism portion 15 in order to perform this rocking operation.

The rocking mechanism portion 15 of this embodiment includes a rocking drive unit 16 which forcibly rotates the movable frame 11 in a reciprocating manner with respect to the fixed frame 10 while taking the rocking center A2 as a support point.

The movable frame 11 further includes a third frame 11*c* extending forward from the second frame 11*b*. The rocking drive unit 16 is provided between this third frame 11*c* and the fixed frame 10.

Figure 6:
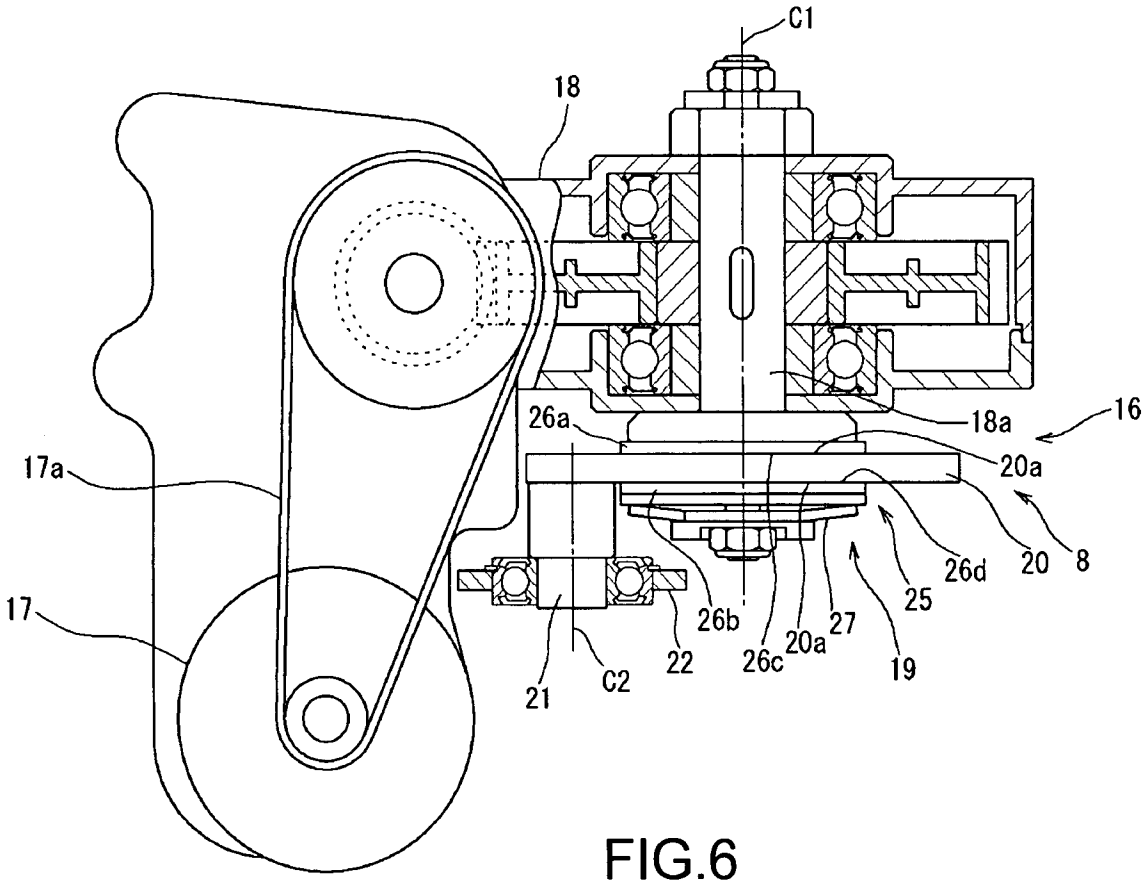
FIG. 6 is an explanatory diagram of a rocking drive unit when seen from the upper direction.

FIG. 6 is an explanatory diagram of the rocking drive unit 16 when seen from the upper direction and is a sectional view of a part thereof. The rocking drive unit 16 includes a motor 17, a decelerator 18 for decelerating the revolution of the motor 17, and a link portion 19 for converting the rotation movement of an output shaft 18*a* of the decelerator 18 into a reciprocating movement of the movable frame 11 (that is, the seat portion 1 and the backrest portion 2) in the front-back direction about the rocking center A2. In addition, the drive force of the motor 17 is input to the decelerator 18 via a belt 17*a*.

In this embodiment (see FIG. 5), the arrangement is made such that the motor 17 and the decelerator 18 are fixed to the third frame 11*c*, the link portion 19 is disposed between the output shaft 18*a* of the decelerator 18 and the fixed frame 10, and the center line of the output shaft 18*a* is directed to the horizontal direction.

Although not shown in the drawing, another configuration is also applicable in which the motor 17 and the decelerator 18 are fixed to the fixed frame 10, and the link portion 19 is disposed between the output shaft 18*a* of the decelerator 18 and the third frame 11*c*, in an opposite manner.

The link portion 19 includes a rotation plate (rotation member) 20 with a disc shape, which is provided coaxially with the output shaft 18*a* and integrally rotatable with the output shaft 18*a*, an eccentric shaft 21 attached to the rotation plate 20, and a crank member 22 provided between this eccentric shaft 21 and the fixed frame 10 (foot portion 10*a*).

When the output shaft 18*a* rotates about the center line (rotation center C1), the rotation force is transmitted to the rotation plate 20, and the rotation plate 20 rotates about the center line. The eccentric shaft 21 is attached to the rotation plate 20 while taking a shaft line C2, which is eccentric with respect to the rotation center C1 of the rotation plate 20, as its center.

One end portion of the crank member 22 is rotatably attached to the eccentric shaft 21, and the other end portion is rotatably attached to a support shaft 53 (see FIG. 5) provided in the fixed frame 10.

With this configuration of the link portion 19, the output shaft 18*a* of the decelerator 18 and the rotation plate 20 are sequentially rotated in one direction when the motor 17 is sequentially rotated in one direction. Thus, the eccentric shaft 21 provided on the rotation plate 20 performs a circular movement about the rotation center C1, and this circular movement is converted into the reciprocating movement (FIGS. 4 and 5) of the movable frame 11 in the front-back direction by the crank member 22. That is, the reciprocating crank mechanism is configured by this link portion 19.

In this first embodiment, a drive apparatus 35 for driving the reclining of the backrest portion 2 is provided as shown in FIGS. 1 and 2. In addition, this drive apparatus 35 and the rocking drive unit 16 (see FIG. 4) are provided in the center area of the frame 4 while being aligned in the horizontal direction.

This drive apparatus 35 is an extensible actuator constituted by a motor and a threaded rod, the front end portion thereof is attached to the third frame 11*c*, and the back end portion thereof is attached to the frame 2*a* of the backrest portion 2. In addition, the drive apparatus 35 may be an air actuator which expands and contracts due to the supply and the discharge of air.

The backrest portion 2 is in the raised state when the actuator is in an extending state (FIG. 1) while the backrest portion 2 is in the reclining state when the actuator is in a contracting state (FIG. 2). When the actuator is maintained in the contracting state, the reclining angle of the backrest portion 2 with respect to the seat portion 1 is set (restrained).

In the chair type massage machine, a controller to be operated by the user (not illustrated) is installed. When the user selects a start button of the rocking operation, which is provided in the controller, a control apparatus 6 for controlling the operation of each portion drives the drive apparatus 35 to turn the backrest portion 2 from the raised state to the reclining state (see FIGS. 2 and 4) and starts the operation of the rocking drive unit 16. With this operation, it is possible to rotate the movable frame 11 in the front-back direction in a reciprocating manner with respect to the fixed frame 10 and to execute the rocking operation of swinging the backrest portion 2, the seat portion 1, and the leg-rest portion 3 in the front-back direction while taking the rocking center A2 as a support point.

Accordingly, it is possible to swing the user's body (entire body) sitting on the seat portion 1 in a wide area in the front-back direction. That is, regarding the track of this rocking operation (the track in the center portion of the chair type massage machine), the displacement in the front-back direction is sufficiently greater than that in the vertical direction. In FIG. 4, a thick line represents the track in the reclining center A1.

In addition, since the backrest portion 2 is in the reclining state, it is possible to swing the user's body in the front-back direction while keeping the user's upper body folded backward and leaning against the backrest portion 2. As a result, it is possible to enhance the relaxing effect to be provided to the user.

Furthermore, since the backrest portion 2 is in the reclining state, a part of the user's upper body is placed on the treatment elements 7. Accordingly, by causing the treatment elements 7 to execute the massage operation while swinging the user's body in the front-back direction by the operation control of the control apparatus 6, it is possible to additionally provide the user with a treatment effect by the treatment elements 7 in addition to the relaxing effect.

In addition, the track of the rocking operation in this embodiment is a circular arc shape which protrudes upward. With the rocking operation having such a track, the track in the reclining center A1 has a peak portion. Accordingly, the track includes a wider range for causing the movement in the front-back direction.

Moreover, regarding the track of this rocking operation in the reclining center A1, for example, the width W in the front-back direction is longer than that in the vertical direction, and the rocking center A2 exists in the range of the width W in the front-back direction of the track in FIG. 4. That is, this means that the reclining center A1 and the rocking center A2 are set apart from each other in the vertical direction but exist so as to be close to each other in the front-back direction.

Since the reclining center A1 and the rocking center A2 exist so as to be close to each other in regard to the positions in the front-back direction as described above, it is possible to more effectively swing the user's body in the front-back direction and thereby to provide the user with a comfortable feeling.

That is, if the rocking center exists at an excessively forward position as compared with the reclining center, a component for the swing in the vertical direction becomes greater than the component for the swing in the front-back direction in the backrest portion even when the seat portion and the backrest portion are rotated in a reciprocating manner about the rocking center. The vertical movement becomes great in the head portion in particular. On the contrary, if the rocking center exists at an excessively backward position as compared with the reclining center, an action works on the user sitting on the seat portion such that the user slips off in a forward direction from the seat portion.

On the other hand, since the reclining center A1 and the rocking center A2 exist so as to be close to each other in regard to the positions in the front-back direction in this embodiment, it is possible to prevent the component for the swinging the head in the vertical direction from becoming greater and to prevent the user from coming close to slipping off in a forward direction. In addition, the positions of the reclining center A1 and the rocking center A2 are applicable as long as they exist so as to be close to each other in regard to the positions in the front-back direction, and the range thereof is applicable as long as it includes the track in the reclining center A1 and the rocking center A2 exists within the range of the dimension in the front-back direction, which is twice as long as the width W of the track.

According to the rocking mechanism portion 15 of this embodiment, one-way forward movement of the rocking operation is performed when the rotation plate 20 is half-rotated, and one-way backward movement is performed by the next half rotation as shown in FIGS. 4 and 5. That is, one reciprocating rocking operation is performed every time the rotation plate 20 rotates once. As described above, the reciprocating crank mechanism is constituted by including the rotation plate 20, the eccentric shaft 21, and the crank member 22. With this configuration, the reciprocating movement in the front-back direction is repeatedly performed by continuously rotating the rotation plate 20 in one direction. When the eccentric shaft 21 on the rotation plate 20 reaches the upper portion, the track end portion on the front side of the rocking operation is reached. When the eccentric shaft 21 reaches the lower portion, the track end portion on the back side of the rocking direction is reached.

The output shaft 18*a* of the decelerator 18 is rotated at a constant speed when the motor 17 is rotated at a constant speed. However, the component of the movement speed in the front-back direction in the rocking operation is slowed both in the state in which the eccentric shaft 21 exists at the upper portion and in the state in which the eccentric shaft 21 exists at the lower portion due to the reciprocating crank mechanism.

This is because even when the eccentric shaft at one end portion of the crank member eccentrically rotates about the rotation center at a constant speed in the reciprocating crank mechanism, the moving speed of the crank member in the reciprocating movement direction on the side of the other end portion sequentially (in sinusoidal manner) varies in accordance with the position (phase) of the eccentric shaft in general. In particular, this is because the movement speed becomes a minimum at the positions where the eccentric shaft is at the upper dead point and the lower dead point.

That is, since the reciprocating crank mechanism is provided as described above in this embodiment, the relative movement speed of the eccentric shaft 21 with respect to the support shaft 53 on the other end portion side of the crank member 22 in regard to the rocking operation direction (reciprocating movement direction) of the eccentric shaft 21 sequentially (in sinusoidal manner) varies in accordance with the position (phase) of the eccentric shaft 21 even if the eccentric shaft 21 at one end portion of the crank member 22 rotates about the rotation center (center line C1) at a constant speed. For this reason, if the position of the eccentric shaft 21 in the rotation plate 20 is set in accordance with the rocking operation position of the movable frame 11, the configuration can be made such that the component of the movement speed in the front-back direction in the rocking operation becomes slower both in the state in which the eccentric shaft 21 exists at the upper portion and in the state in which the eccentric shaft 21 exists at the lower portion. Specifically, the setting may be made such that the movable frame 11 corresponds to the track end portion of the rocking operation at the position where the eccentric shaft 21 is at the upper dead point and the lower dead point in the circular arc track about the rocking center A2.

As described above, according to the link portion 19 of this embodiment, it is possible to provide a function as a speed changing portion 8 for changing the component of the movement speed of the reciprocating movement in the front-back direction when the movable frame 11 moves about the rocking center A2 in a reciprocating manner.

While the seat portion 1 and the like are swung in the front-back direction along a prescribed track, this speed changing portion 8 makes it possible to gradually lower the swinging speed as the seat portion 1 and the like approach the front and back track end portions. With such a configuration, the speed component for moving in the front-and back direction does not become larger both at the front and back track end portions. As a result, the inertial force makes it possible to prevent the user's body from slipping forward or backward with respect to the seat portion 1, and it is possible to provide the user with more a comfortable swinging feeling.

It can be considered that the control apparatus 6 performs the speed control of the rotation of the motor 17 in order to change the movement speed in the front-back direction in the rocking operation. However, such a control is not necessary in this embodiment as long as the motor 17 is rotated at a constant speed.

As shown in FIG. 2, a reaction member 36 is provided for causing a large force in a direction in which the rocking operation is interrupted particularly when the seat portion 1 and the like approach the track end portions in the rocking operation. The force by the reaction member 36 caused in the direction in which the rocking operation is interrupted is set to be small or to be zero in the track center portion.

The reaction member 36 of this embodiment is a spring 36*a* and provided between the fixed frame 10 and the movable frame 11. This spring 36*a* makes it possible to reduce the load to the motor 17 and the decelerator 18 by causing a spring force in the direction in which the rocking operation is interrupted.

Figure 7A:
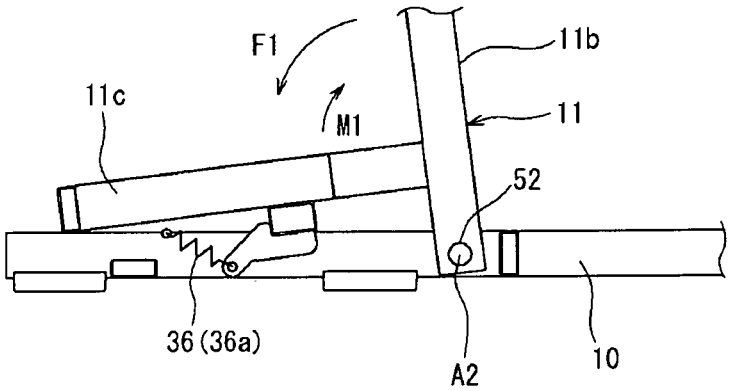
FIGS. 7A and 7B are explanatory diagrams of a reaction member.

That is, as shown in FIG. 7A, a force (arrow F1) to rotate further forward works on the movable frame 11 due to the weight of the user on the backrest portion 2 and the seat portion 1 and the inertial force in the state in which the seat portion 1 and the like are swung forward and in the front position state (FIG. 2) where the seat portion 1 and the like are moved to the front track end portion. Thereafter, while acting against the above force, the motor 17 and the decelerator 18 need to drive the movable frame 11 to move backward, that is, in the opposite direction. Therefore, a large load acts on the motor 17 and the decelerator 18.

In this state, the spring 36*a* is changed to an extending state from its original state. A restoring force of the spring 36*a* provides a force (moment) M1 in a direction which is opposite to the direction of the above force (arrow F1) and in which the movable frame 11 returns backward to the movable frame 11. With this configuration, it is possible to reduce the load to the motor 17 and the decelerator 18.

Figure 7B:
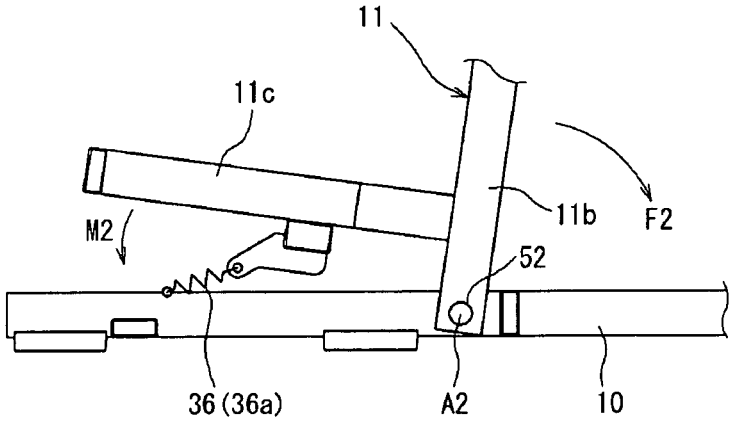

In the opposite manner, as shown in FIG. 7B, a force (arrow F2) to rotate further backward works on the movable frame 11 in the state in which the seat portion 1 and the like are swung backward and in the back position state (FIG. 5) where the seat portion 1 and the like are moved to the back track end portion. In this case, while acting against the above force, the motor 17 and the decelerator 18 need to drive the movable frame 11 to move forward, that is, in the opposite direction. Therefore, a large load acts on the motor 17 and the decelerator 18.

In this state, the spring 36*a* is changed to an extending state from its original state. A restoring force of the spring 36*a* provides a force (moment) M2 in a direction which is opposite to the direction of the above force (arrow F2) and in which the movable frame 11 returns forward to the movable frame 11. With this configuration, it is possible to reduce the load to the motor 17 and the decelerator 18.

The intermediate track center portion between the back track end portion and the front track end portion is in the state in which the rocking center A2 exists on the extended line of the spring 36*a* in the longitudinal direction, that is, on the extended line in a direction in which the elastic force (restoring force) of the spring 36*a* acts. Therefore, no moment about the rocking center A2 occurs, and the force caused in the direction in which the rocking operation is interrupted becomes zero.

The configuration of this embodiment is made such that the drive force of the motor 17 is transmitted to the movable frame 11 via the link portion 19 in ordinary operation to swing the seat portion 1 and the like in the front-back direction.

However, a power transmission releasing portion 25 (see FIG. 6) is provided for releasing this power transmission in an abnormal situation.

That is, although the drive force of the motor 17 is transmitted to the output shaft 18*a* of the decelerator 18, skidding is configured to occur when the torque of not less than a prescribed allowable torque acts between the output shaft 18*a* and the rotation plate 20.

In order to obtain this configuration, the output shaft 18*a* is provided with pinching members 26*a* and 26*b* for pinching the rotation plate 20 from its front and back sides, and these pinching members 26*a* and 26*b* are always rotated integrally with the output shaft 18*a*. In addition, the output shaft 18*a* is provided with an elastic member (disc spring in this embodiment) 27 for providing the force for pinching the rotation plate 20 with the pinching members 26*a* and 26*b*. These pinching members 26*a* and 26*b* and the elastic member 27 are included in the power transmission releasing portion 25.

In addition, the rotation plate 20 is not fixed to the output shaft 18*a* in the rotation direction, and the rotation plate 20 can be rotated integrally with the output shaft 18*a* by the pinching force of the pinching members 26*a* and 26*b* with the use of the elastic member 27. Moreover, the rotation plate 20 is mechanically connected to the fixed frame 10 via the crank member 22.

Accordingly, when the torque of not less than the prescribed allowable torque acts between the output shaft 18*a* and the rotation plate 20, skidding occurs between a side face 20*a* of the rotation plate 20 and the pinching surfaces 26*c* and 26*d* of the pinching members 26*a* and 26*b*, and the power transmission is released.

As described above, a case in which the backrest portion 2 is in contact with an obstacle on its back face and the operation of swinging the backrest portion 2 and the seat portion 1 in the front-back direction is interrupted corresponds to the case when the torque of not less than the prescribed allowable torque acts, for example.

As described above, when the operation of swinging the seat portion 1 and the like in the front-back direction is interrupted, the allowable torque acts, and the skidding occurs between the rotation plate 20 and the pinching members 26*a* and 26*b*. Furthermore, all the drive force of the motor 17 to swing the seat portion 1 and the like in the front-back direction is not transmitted to the movable frame 11, and the seat portion 1 and the like can be prevented from being forcibly moved.

According to this power transmission releasing portion 25, the drive force for swinging is not forcibly transmitted to the seat portion 1 and the like when the seat portion 1 and the like are in contact with an obstacle and the swinging operation is interrupted in the course of the swinging operation. Therefore, it is possible to prevent a large load from acting on the backrest portion 2, the seat portion 1, the leg-rest portion 3 side, and the rocking drive unit 16 side for swinging and thereby to prevent malfunction of the chair type massage machine.

Second Embodiment

Figure 8:
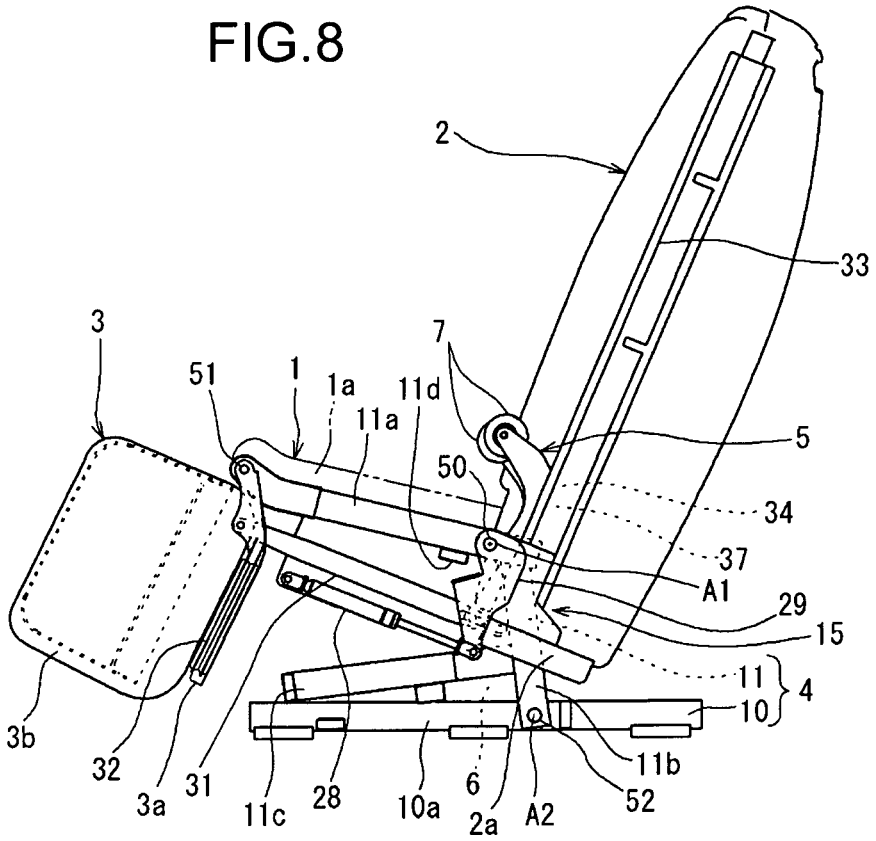
FIG. 8 is a side view of a massage machine (of a second embodiment) of the present invention.
Figure 9:
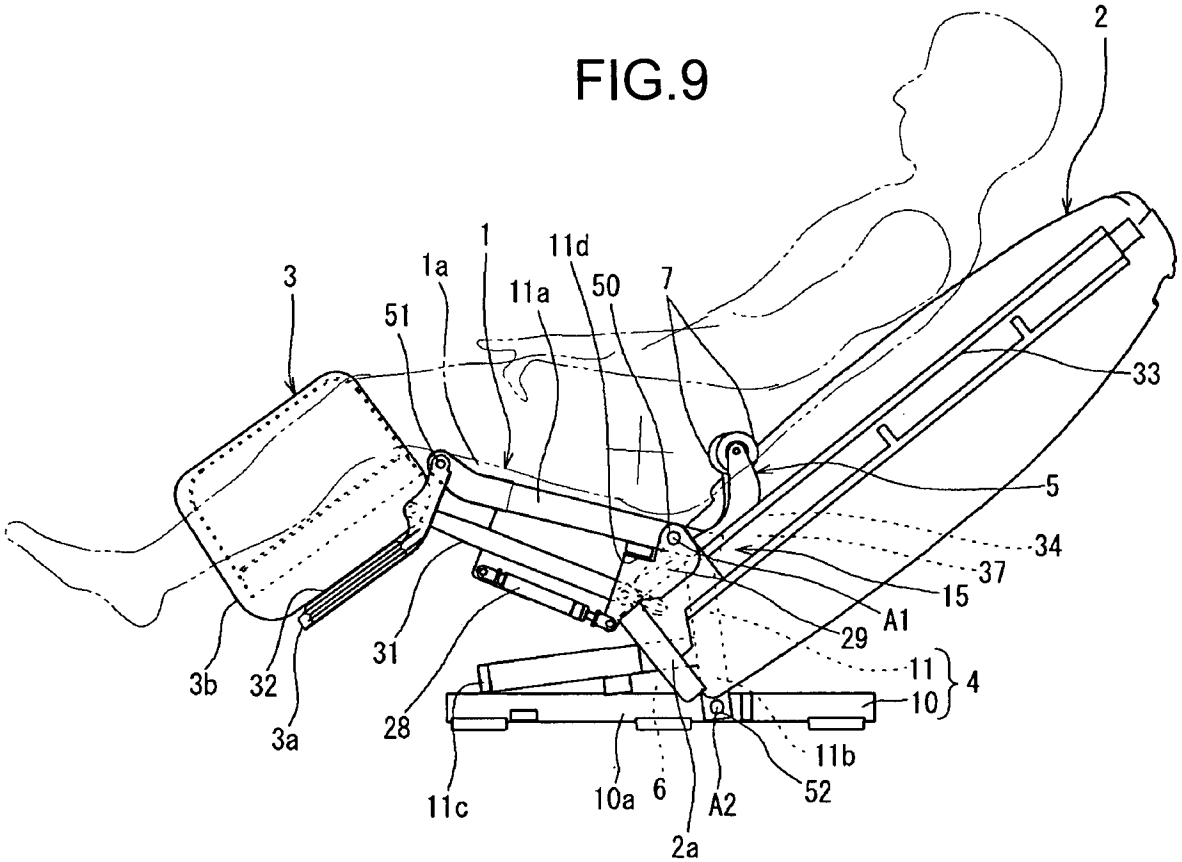
FIG. 9 is a side view of the massage machine (of the second embodiment) in the reclining state.

FIGS. 8 and 9 are side views for illustrating the configuration of the chair type massage machine according to the second embodiment of the present invention. The second embodiment is different from the first embodiment (FIGS. 1 and 2) in that the drive apparatus 35 for reclining drive is not provided. However, these two embodiments are the same in regard to other configurations. In addition, a damper 28 is provided instead of the drive apparatus 35 in the second embodiment. The damper 28 is attached between a fixed member 29 fixed to the frame 2*a* of the backrest portion 2 and the movable frame 11 (a member fixed to the first frame 11*a*).

Through the function of the damper 28, it is possible to maintain the backrest portion 2 in the raised state by its bias force as shown in FIG. 8. When the user sitting on the seat portion 1 leans against the backrest portion 2, it is possible to turn the backrest portion 2 to the reclining state as shown in FIG. 9. In addition, when the user dampens the leaning force against the backrest portion 2, the damper 28 can return the backrest portion 2 in the reclining state to the raised state by its bias force.

In this second embodiment as well, by the same rocking mechanism portion 15 as that in the first embodiment, it is possible to swing the backrest portion 2 in the reclining state due to the user leaning against it along with the seat portion 1 and the leg-rest portion 3 in the front-back direction while taking a position which is apart from the reclining center A1 in the vertical direction as a rocking center A2.

Third Embodiment

Figure 10:
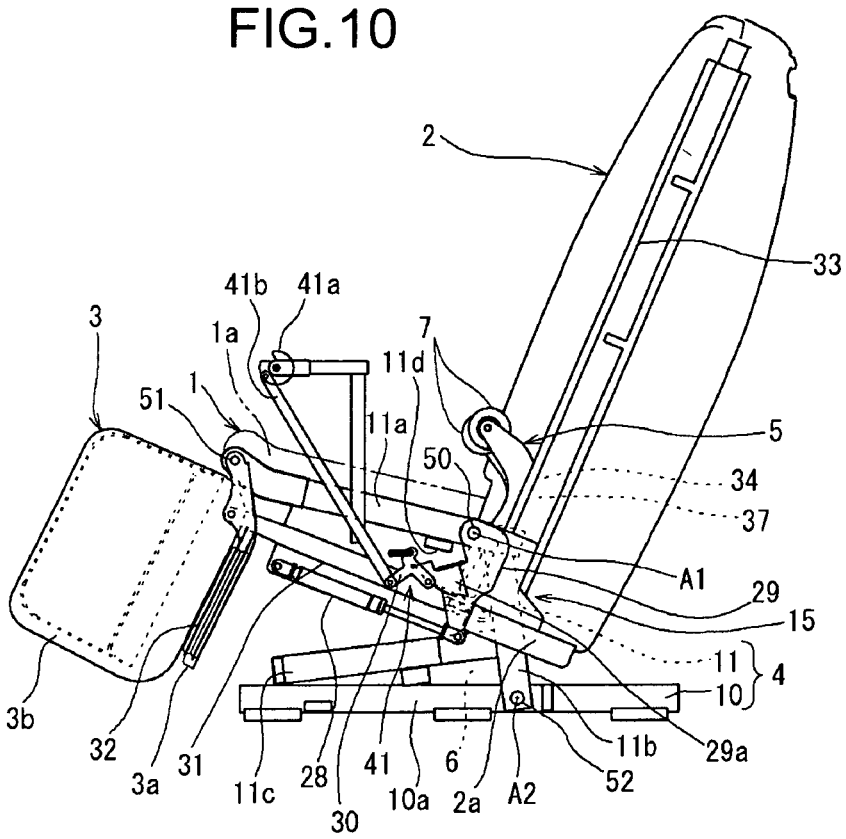
FIG. 10 is a side view of a massage machine (of a third embodiment) of the present invention.
Figure 11:
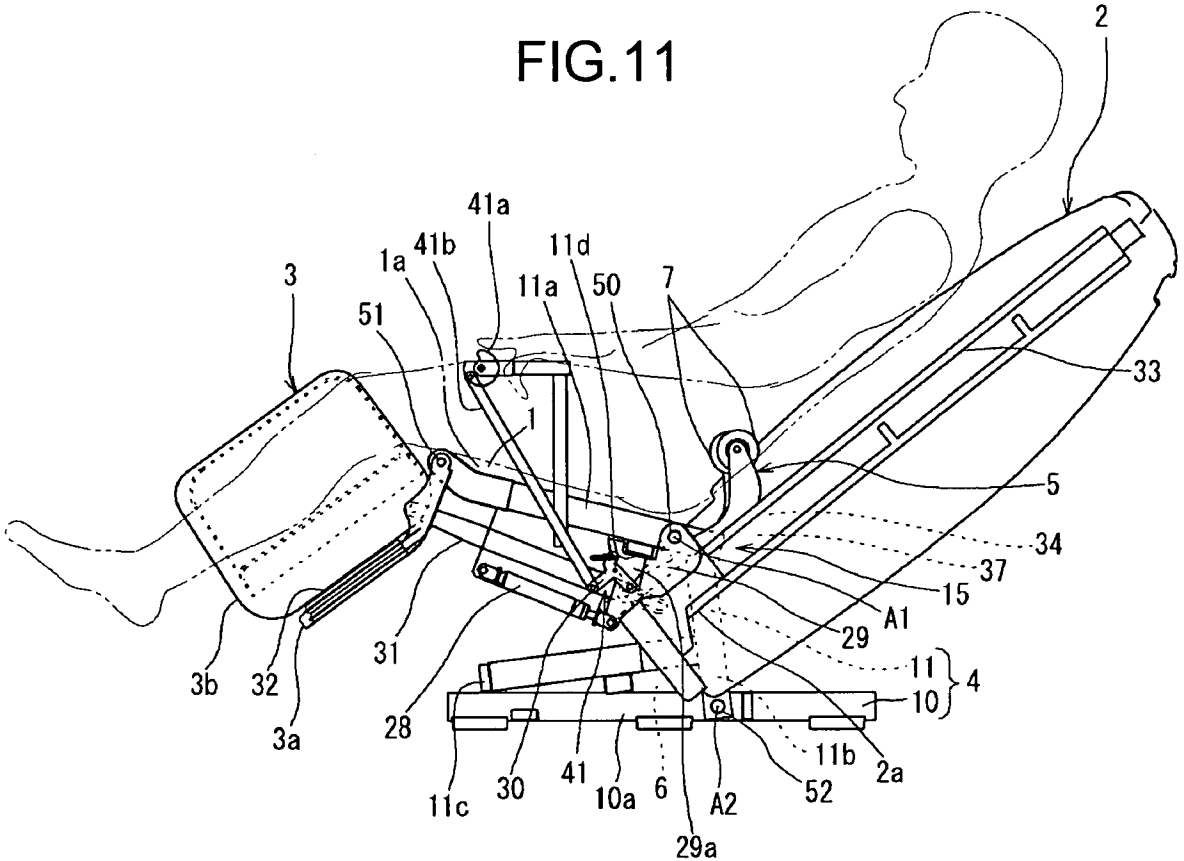
FIG. 11 is a side view of the massage machine (of the third embodiment) in the reclining state.

FIGS. 10 and 11 are side views for illustrating the configuration of the chair type massage machine according to the third embodiment of the present invention. The third embodiment is different from the second embodiment (FIGS. 8 and 9) in that a restraint portion 41 capable of restraining the posture (state) of the backrest portion 2 with respect to the movable frame 11 is further provided. However, these two embodiments are the same in regard to other configurations.

A description will be made of this restraint portion 41. The fixed member 29 is fixed to the frame 2*a* of the backrest portion 2 (in the same manner as in the second embodiment), and the fixed member 29 is further provided with an engaged portion 29*a*. Accordingly, the engaged portion 29*a* is rotated about the reclining center A1 integrally with the backrest portion 2.

In addition, although not shown in the drawings, the chair type massage machine is provided with armrest portions. The armrest portions are provided with an operation portion 41*a* for operating the restraint portion 41.

Figure 12A:
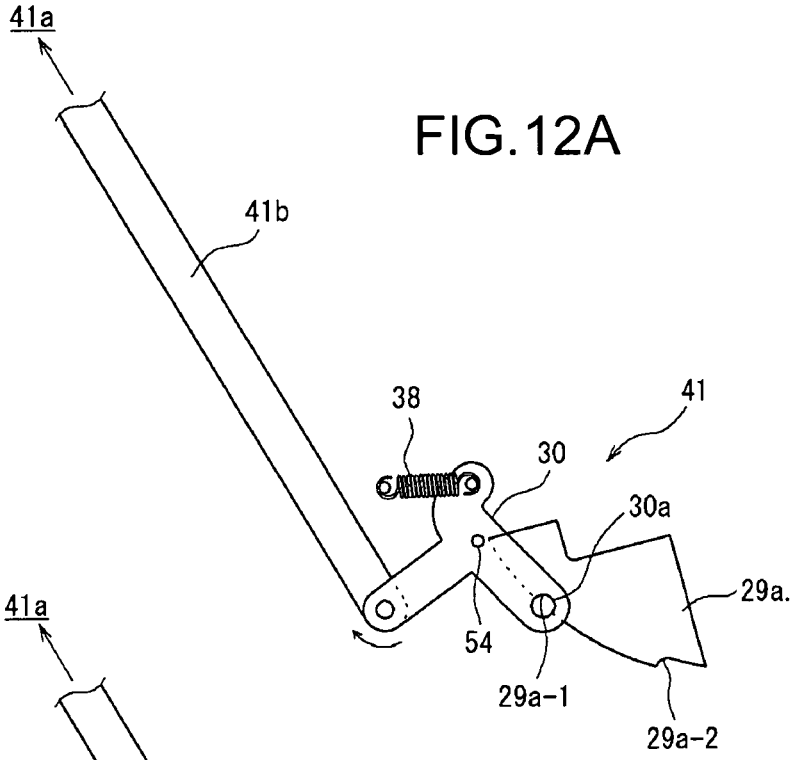
FIGS. 12A and 12*b* are explanatory diagrams for illustrating the function of a restraint portion.
Figure 12B:
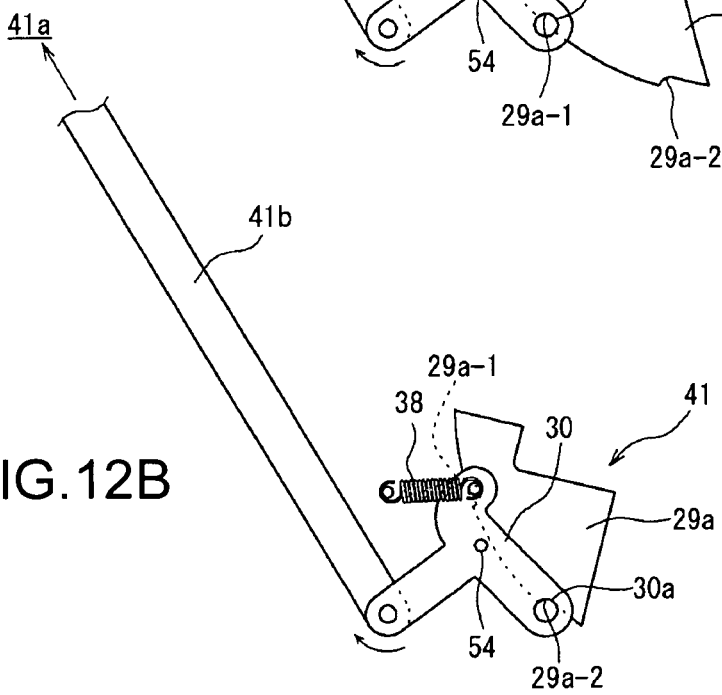

FIGS. 12A and 12B are explanatory diagrams for illustrating the function of the restraint portion 41. The restraint portion 41 includes an engaging member 30 for engaging with the engaged portion 29*a* and a connecting member 41*b* which connects the operation portion 41*a* and the engaging member 30 and is interlocked with the operation of the operation portion 41*a* to move the engaging member 30. The engaging member 30 is rotatably attached to the movable frame 11 (a member fixed to the first frame 11*a*) via a shaft 54.

Two concave portions 29*a*-1 and 29*a*-2 are formed in the engaged member 29*a*, and a convex portion 30*a* included in the engaging member 30 engages with any one of the concave portions 29*a*-1 and 29*a*-2. In FIGS. 12A and 12B, the concave portions 29*a*-1 and 29*a*-2 are notch portions formed in the plate-shaped engaged portion 29*a*, and the convex portion 30*a* is a pin attached to the engaging member 30.

As shown in FIG. 12A, the engaged portion 29*a* cannot move with respect to the engaging member 30 in the state in which the convex portion 30*a* is engaging with the concave portion 29*a*-1, which is one of the concave portions. As a result, the backrest portion 2 cannot be rotated with respect to the movable frame 11. At this time, the engaging member 30 is biased by the spring 38, and the engaging state is maintained. For this reason, the backrest portion 2 is maintained in the raised state as shown in FIG. 10 even if the user leans against the backrest portion 2.

However, when the operation portion 41*a* is operated, the engaging member 30 acts against the spring 38 via the connecting member 41*b* and rotates about the shaft 54, and the engagement between the convex portion 30*a* and the concave portion 29*a*-1 is released. In this state, the engaged portion 29*a* can be moved with respect to the engaging member 30, and the backrest portion 2 can be turned to be in the reclining state as shown in FIG. 11 if the user leans against the backrest portion 2. When the backrest portion 2 is turned to be in the reclining state, the engaged portion 29*a* is rotated, and the convex portion 30*a* is in the position where the convex portion 30*a* can engage with the concave portion 29*a*-2, which is the other concave portion.

In the state in which the operation of the operation portion 41*a* is released and the convex portion 30*a* and the concave portion 29*a*-2 are engaged as shown in FIG. 12B, the engaged portion 29*a* cannot be moved with respect to the engaging member 30, and as a result, the backrest portion 2 cannot be rotated with respect to the movable frame 11. Accordingly, the reclining state is maintained as shown in FIG. 11 even if the user leaves the backrest portion 2. That is, the backrest portion 2 is turned to the state in which the backrest portion 2 is restrained by the movable frame 11.

If the operation portion 41*a* is operated in this state to release the restraint of the backrest portion 2, and the user dampens the leaning force against the backrest portion 2, the backrest portion 2 in the reclining state can be returned to be in the raised state by the damper 28.

In this third embodiment as well, it is possible to swing the backrest portion 2 maintained in the reclining state along with the seat portion 1 and the leg-rest portion 3 in the front-back direction while taking a position which is different from the reclining center A1 in the vertical direction as a rocking center A2, by the rocking mechanism portion 15 which is the same as that in the first embodiment.

In the second and third embodiments, when the backrest portion 2 is in the raised state (FIGS. 8 and 10), the fixed member 29 is set apart from a contact portion 11*d* of the movable frame 11 (first frame 11*a*), and the reclining operation of the backrest portion 2 is not interrupted. However, when the backrest portion 2 is in the reclining state (FIGS. 9 and 11), the fixed member 29 comes in contact with the contact portion 11*d* of the movable frame 11 (first frame 11*a*) from the lower side, and further reclining operation of the backrest portion 2 can be interrupted. Accordingly, when the backrest portion 2 is in the reclining state, the backrest portion 2 and the seat portion 1 are not moved to have a larger open angle and can be integrally rotated about the rocking center A2.

Fourth Embodiment

Figure 13:
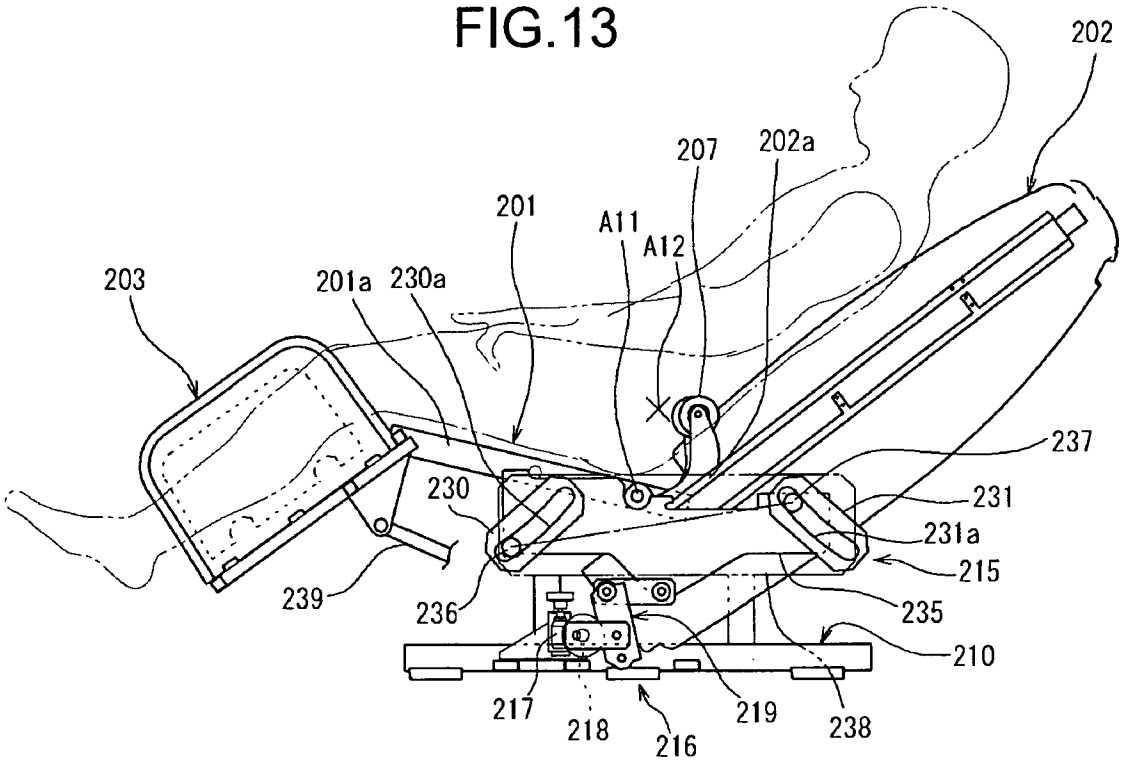
FIG. 13 is a side view of a massage machine (of a fourth embodiment) of the present invention.
Figure 14:
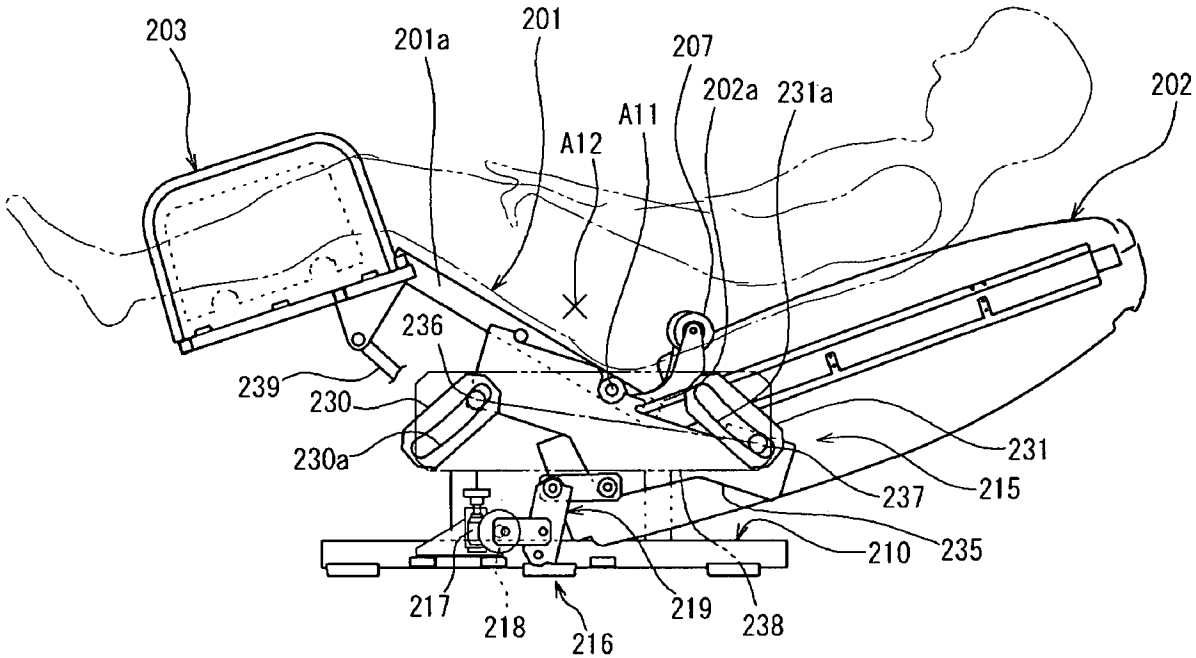
FIG. 14 is a side view of the massage machine (of the fourth embodiment) of the present invention.

FIGS. 13 and 14 are side views for illustrating the configuration of the chair type massage machine according to the fourth embodiment of the present invention. This chair type massage machine includes a seat portion 201 on which the user sits, a backrest portion 202 provided with treatment elements 207 for performing massage operation, a leg-rest portion 203 on which the user's legs are placed, and a fixed frame 210 to be installed on the floor surface in the same manner as in the respective embodiments. In addition, the backrest portion 202 is configured to be reclined about a position on the back side of the seat portion 201 as a reclining center A11.

Moreover, this chair type massage machine is provided with a rocking mechanism portion 215 for swinging the backrest portion 202 and the seat portion 201 in the front-back direction while taking a position which is apart or different from the reclining center A11 in the vertical direction as a rocking center A12. In this embodiment, the rocking center A12 is a virtual position existing outside the range of the chair type massage machine in the side view. FIG. 13 shows a state in which the backrest portion 202 and the seat portion 201 are swung forward, and FIG. 14 shows a state in which the backrest portion 202 and the seat portion 201 are swung backward.

The rocking mechanism portion 215 includes front and back guide members 230 and 231 provided on the side of the fixed frame 210, a movable frame 235 which is guided along these guide members 230 and 231, and a rocking drive unit 216 as a drive source for swinging the backrest portion 202 and the seat portion 201 in the front-back direction.

The movable frame 235 is a plate-shaped member fixed to each of the right and left sides of the frame 201*a* of the seat portion 201, and rollers 236 and 237 are attached to the front and back sides of the movable frame 235.

The guide members 230 and 231 include guide portions 230*a* and 231*a* constituted by grooves or long holes for guiding the rollers 236 and 237 and are attached to a fixed wall 238 on the side of the armrest portions which are fixed to the fixed frame 210 (not illustrated).

The guide members 230 and 231 are provided on both the left and right sides of the chair type massage machine and support the seat portion 201 and the backrest portion 202 via the movable frame 235 on both the left and right sides while the rocking operation of the seat portion 201 and the backrest portion 202 can be performed.

The rocking drive unit 216 has substantially the same configuration as that in the first to third embodiments and includes a motor 217, a decelerator 218 for decelerating the revolution of the motor 217, and a link portion 219 for converting the rotation movement of the output shaft of the decelerator 218 into the reciprocating movement of the movable frame 235 in the front-back direction. The link portion 219 moves the movable frame 235 in the front-back direction in a reciprocating manner by rotating the motor 217.

A frame 201*a* of the seat portion 201 is fixed to the movable frame 235, and a frame 202*a* of the backrest portion 202 is supported by the frame 201*a* of the seat portion 201. Accordingly, when the rollers 236 and 237 are guided along the guide members 230 and 231 and the movable frame 235 is moved in the front-back direction in a reciprocating manner, it is possible to cause the seat portion 201 and the backrest portion 202 to perform the rocking operation in the front-back direction.

In addition, this embodiment is configured such that the backrest portion 202 can be reclined with respect to the seat portion 201 while taking the back portion side of the seat portion 201 as a reclining center A11. That is, the frame 202*a* of the backrest portion 202 is rotatably attached to the frame 201*a* of the seat portion 201 by a shaft. In the same manner as in the preceding embodiments, the drive apparatus 35 (see FIG. 2) for the reclining may be provided in addition to an interlocking member 239. Alternatively, the damper 28 (see FIG. 9) may be provided instead of the drive apparatus 35.

Accordingly, in the same manner as in the respective embodiments, it is possible to perform the rocking operation in which the backrest portion 202 in the reclining state is swung in the front-back direction along with the seat portion 201.

Figure 15:
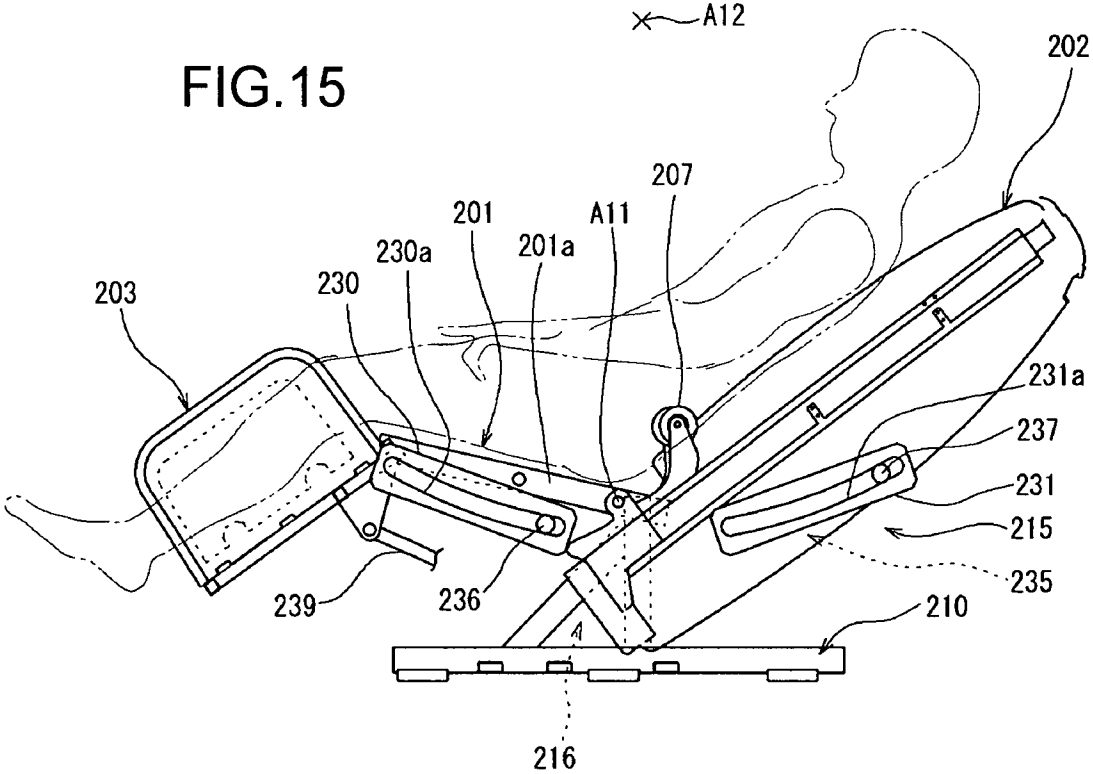
FIG. 15 is a side view of a massage machine (of a modified example of the fourth embodiment) according to the present invention.
Figure 16:
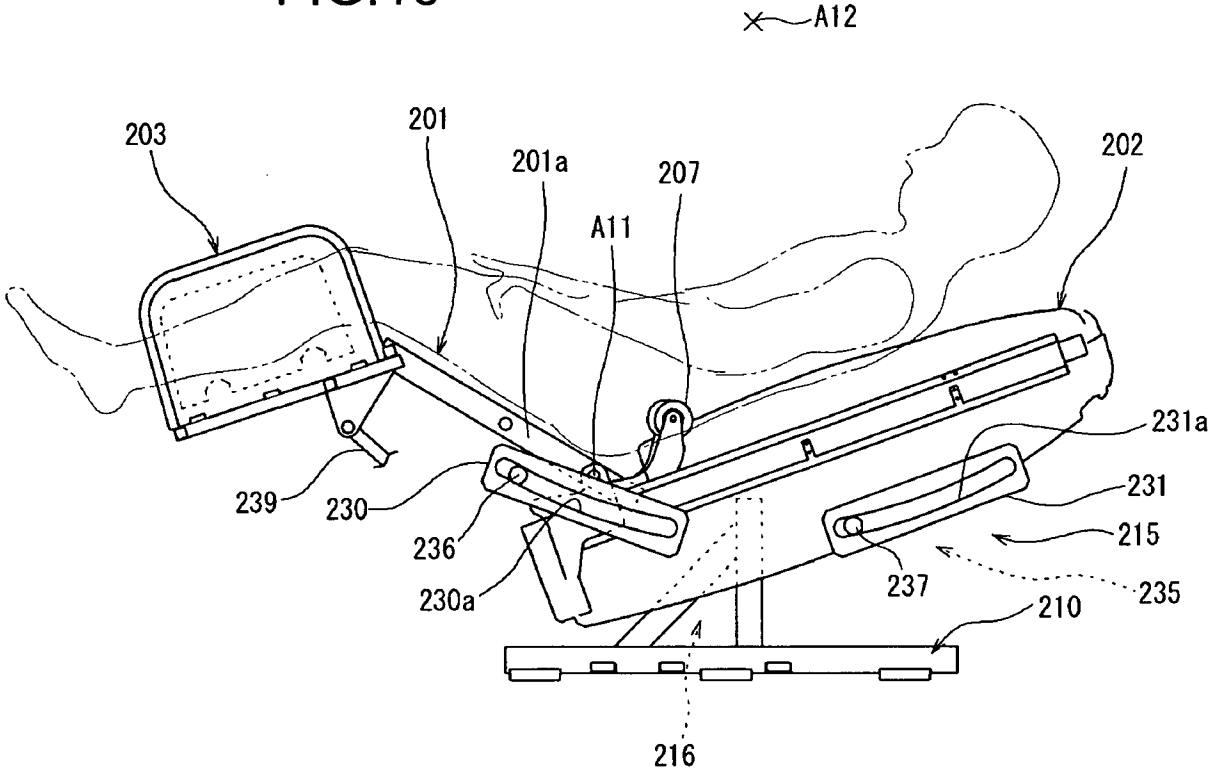
FIG. 16 is a side view of a massage machine (of a modified example of the fourth embodiment) according to the present invention.

The chair type massage machines shown in FIGS. 15 and 16 are modified examples of the embodiments shown in FIGS. 13 and 14, and each of them includes the guide members 230 and 231, the movable frame 235, and the rocking drive unit 216 as the rocking mechanism portion 215 in the same manner. However, the shapes of the guide portions 230*a* and 231*a* of the guide members 230 and 231 are different from those in the embodiments shown in FIGS. 13 and 14.

According to these modified examples, by changing the shapes of the guide portions 230*a* and the 231*a*, it is possible to separate the rocking center A12 from the reclining center A11 and to perform the rocking operation with a track along a large circular arc, whereby the seat portion and the like can swing in a wide area in the front-back direction.

As described above, according to the rocking mechanism portion 215 including the guide members 230 and 231, the movable frame 235 and the rocking drive unit 216 in the embodiments shown in FIGS. 13 and 14 and the embodiments shown in FIGS. 15 and 16 as well, it is possible to swing the backrest portion 202 in the reclining state in the front-back direction along with the seat portion 201 while taking a position which is apart or different from the reclining center A11 in the vertical direction as the rocking center A12.

In this fourth embodiment, it is possible to provide the speed changing portion 8 (FIGS. 4 and 5), the power transmission releasing portion 25 (FIG. 6), the reaction member 36 (FIGS. 7A and 7B), and the restraint portion 41 (FIGS. 12A and 12B) in the same manner as in the first embodiment.

Fifth Embodiment

Figure 17:
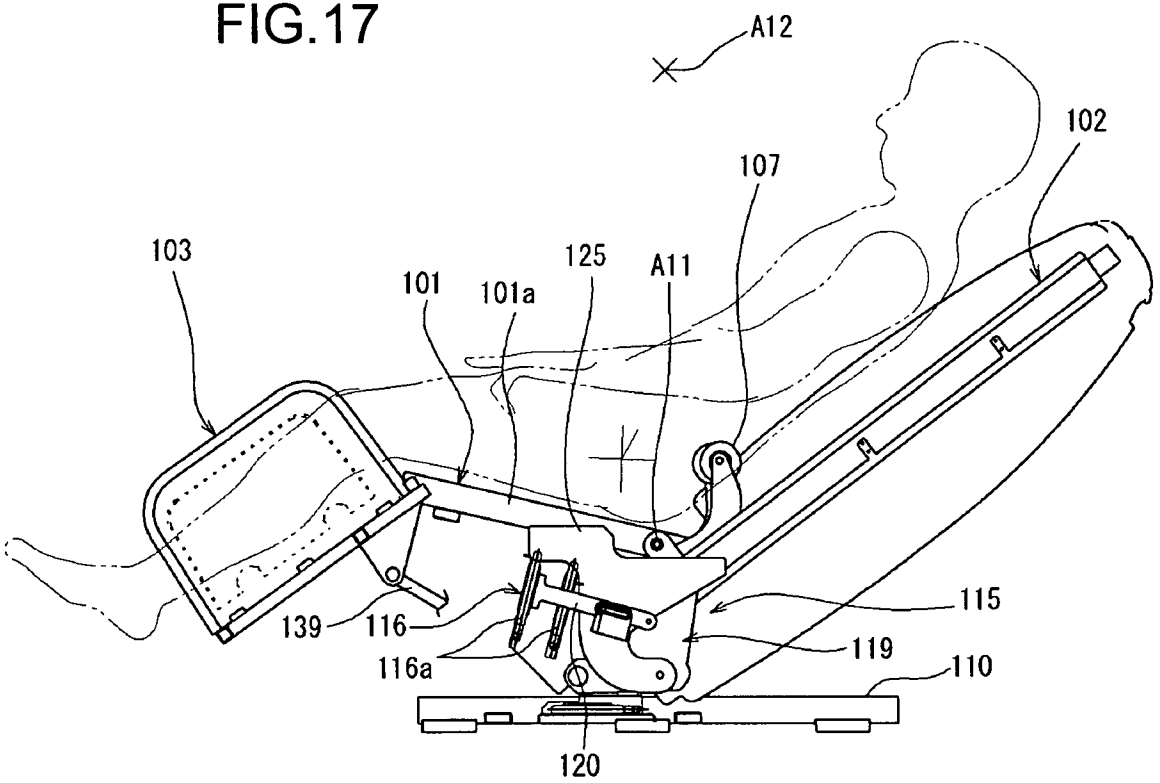
FIG. 17 is a side view of a massage machine (of a fifth embodiment) of the present invention.
Figure 18:
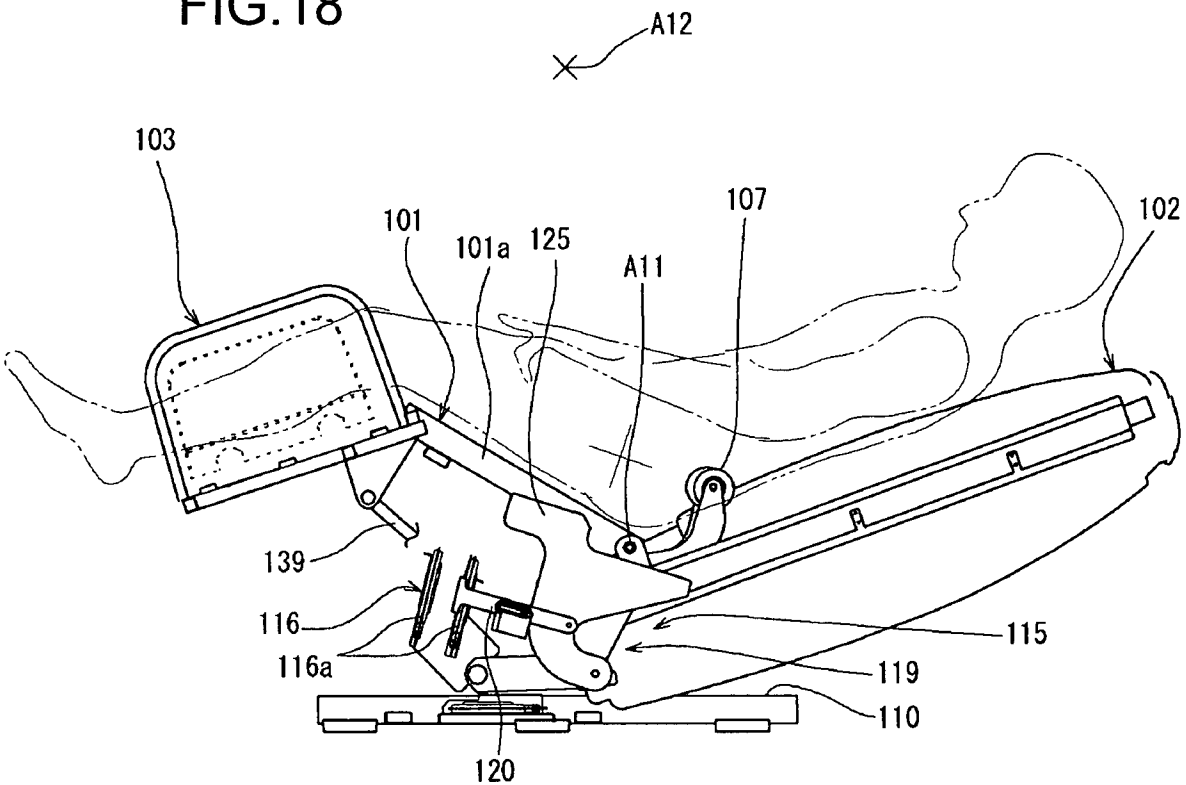
FIG. 18 is a side view of the massage machine (of the fifth embodiment) of the present invention.

FIGS. 17 and 18 are side views for illustrating the configuration of the chair type massage machine according to the fifth embodiment of the present invention. This chair type massage machine includes a seat portion 101 on which the user sits, a backrest portion 102 provided with treatment element 107 for performing massage operations, a leg-rest portion 103 on which the user's legs are placed, and a fixed frame 110 installed on the floor surface in the same manner as in the above respective embodiments. In addition, the backrest portion 102 is configured to be reclined about a position on the back side of the seat portion 101 as the reclining center A11.

Moreover, this chair type massage machine is provided with a rocking mechanism portion 115 for swinging the backrest portion 102 and the seat portion 101 in the front-back direction while taking a position which is apart or different from the reclining center A11 in the vertical direction as a rocking center A12. In this embodiment, the rocking center A12 is a virtual position existing outside the range of the chair type massage machine in the side view. FIG. 17 shows a state in which the backrest portion 102 and the seat portion 101 are swung forward, and FIG. 18 shows a state in which the backrest portion 102 and the seat portion 101 are swung backward.

The rocking mechanism portion 115 includes a link portion 119 provided between the fixed frame 110 and the frame 101*a* of the seat portion 101 and a rocking drive unit 116 as a drive source for swinging the backrest portion 102 and the seat portion 101 in the front-back direction.

The link portion 119 is provided on both the left and right sides of the fixed frame 110 and supports the seat portion 101 and the backrest portion 102 on both the left and right sides while the rocking operation of the seat portion 101 and the backrest portion 102 can be performed.

Each of the rocking drive units 116 shown in FIGS. 17 and 18 is an air actuator including air cells 116*a* which expand or contract due to the supply or the discharge of air and an air unit (not illustrated) for supplying air to the air cells 116*a*. When a pair of front and back air cells 116*a* carries the drive member 120, which extends in the front-back direction, back and forth, the rocking operation of the seat portion 101 and the like becomes possible, which will be described later.

The air cells 116*a* are configured to be able to expand in the front-back direction and carry the drive member 120 in the front-back direction. At the same time, the air cells 116*a* can be freely deformed along with the expansion. In addition, the pair of air cells 116*a* is provided in the chair type massage machine while being rotatable about the horizontal center line.

The drive member 120 driven by the air cells 116*a* is configured to be displaced in regard to the direction other than the drive direction. That is, as shown in the explanatory diagram of the link portion 119 in FIG. 19, a guide shaft 120*a* of the drive member 120 is guided in the drive direction by the guide member 110*d* of the fixed frame 110, and the drive member 120 is movable in the same direction. In addition, the drive member 120 can be swung about the center line of the guide shaft 120*a*.

Figure 19:
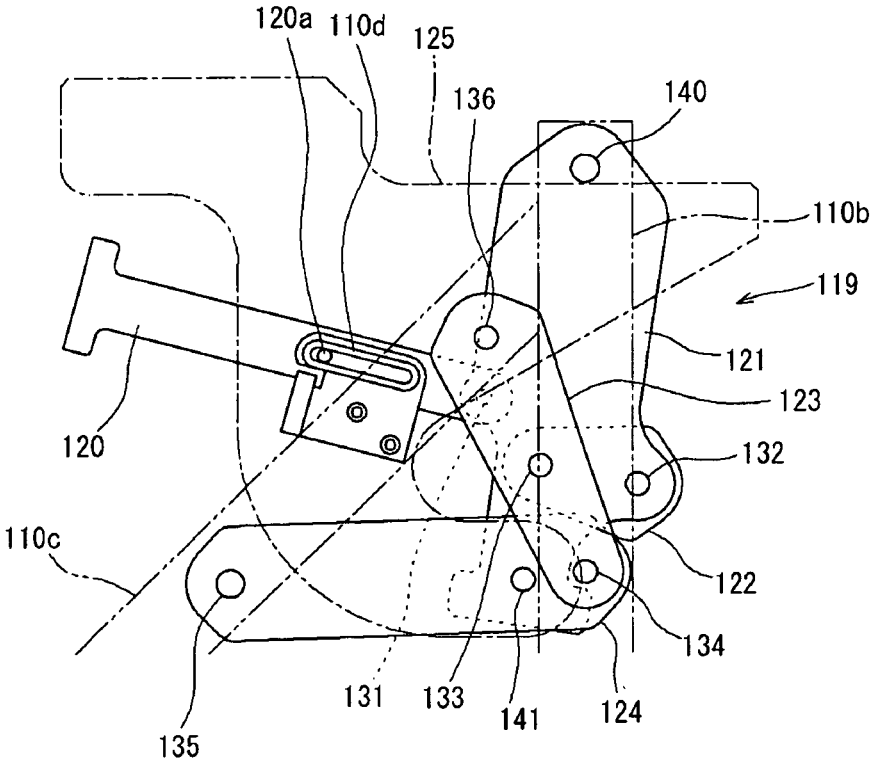
FIG. 19 is an explanatory diagram of a link portion.
Figure 20:
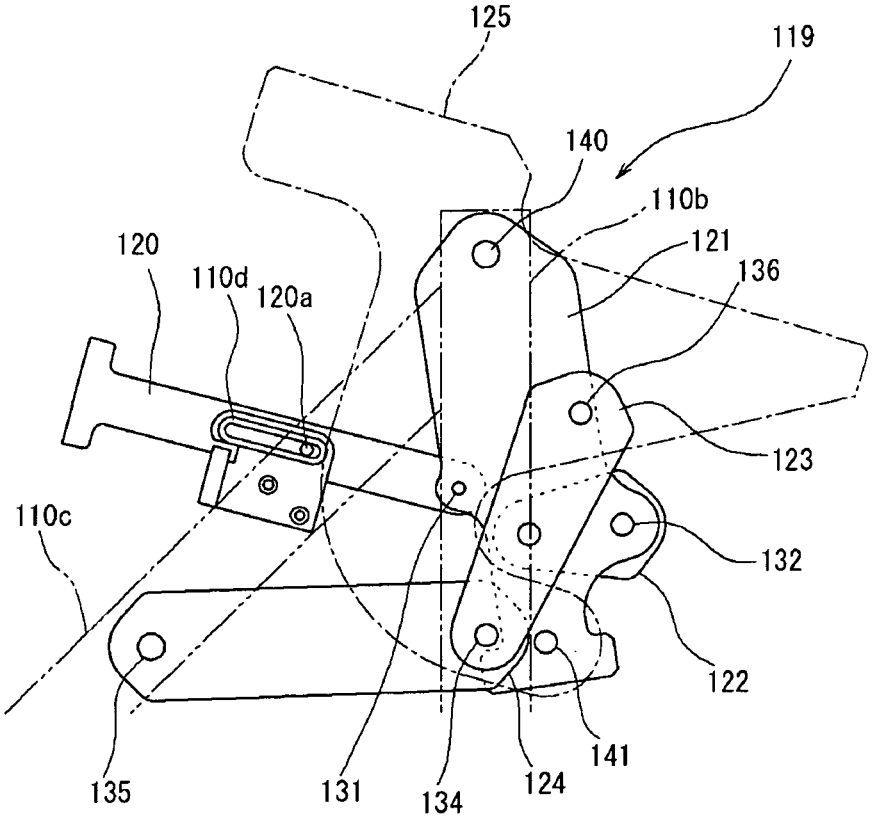
FIG. 20 is an explanatory diagram of the link portion.
Figure 21:
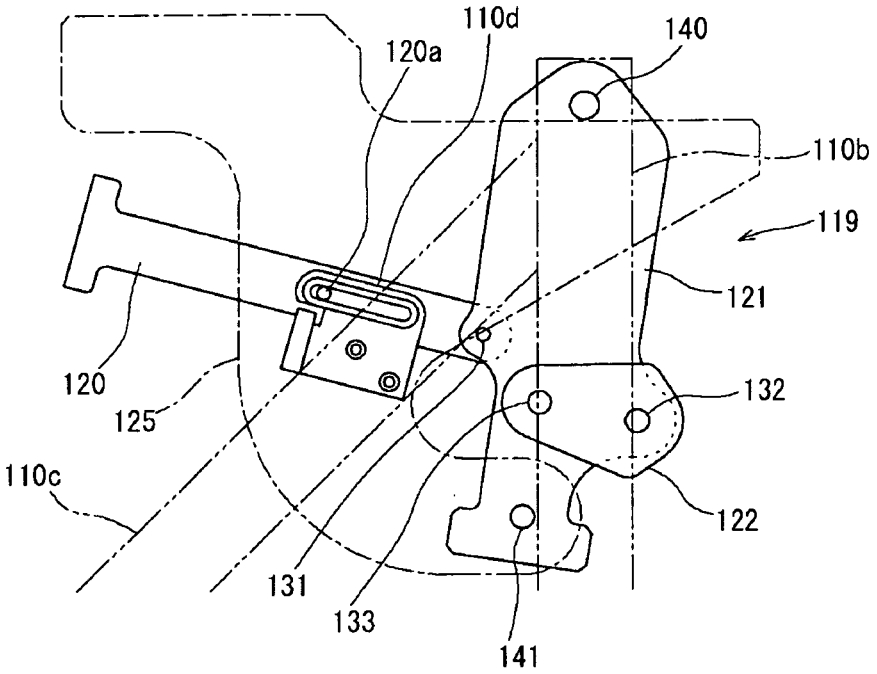
FIG. 21 is an exploded diagram of the link portion.

The link portion 119 is configured to convert the reciprocating linear movement by a thrust force of the air cells 116*a* into the rocking operation of the seat portion 101 and the backrest portion 102. FIGS. 19 and 20 are explanatory diagrams of the link portion 119. FIG. 19 shows the link portion 119 in the state of FIG. 17, and FIG. 20 shows the link portion 119 in the state of FIG. 18. In addition, FIGS. 21 and 22 are exploded diagrams of this link portion 119.

In FIG. 19, the link portion 119 includes a first link member 121, a second link member 122, a third link member 123, a fourth link member 124, and a fifth link member 125. In FIG. 21, one end portion of the first link member 121 is rotatably connected to the first frame 110*b* of the fixed frame 110 via a shaft (seventh shaft) 140, and the other end portion is rotatably connected to a part of the fifth link member 125 via a shaft (eighth shaft) 141. In addition, the frame 101*a* (see FIG. 17) of the seat portion 101 is fixed to the fifth link member 125. By moving this fifth link member 125 in the front-back direction in a reciprocating manner, the seat portion 101 and the backrest portion 102 which is supported by the seat portion 101 via the frame 101*a* are swung in the front-back direction.

A further description will be made of the link portion 119. In FIG. 21, a tip end portion of the drive member 120 is rotatably connected to the intermediate portion of the first link member 121 by the first shaft 131, and this first link member 121 and the second link member 122 are rotatably connected by the second shaft 132.

Figure 22:
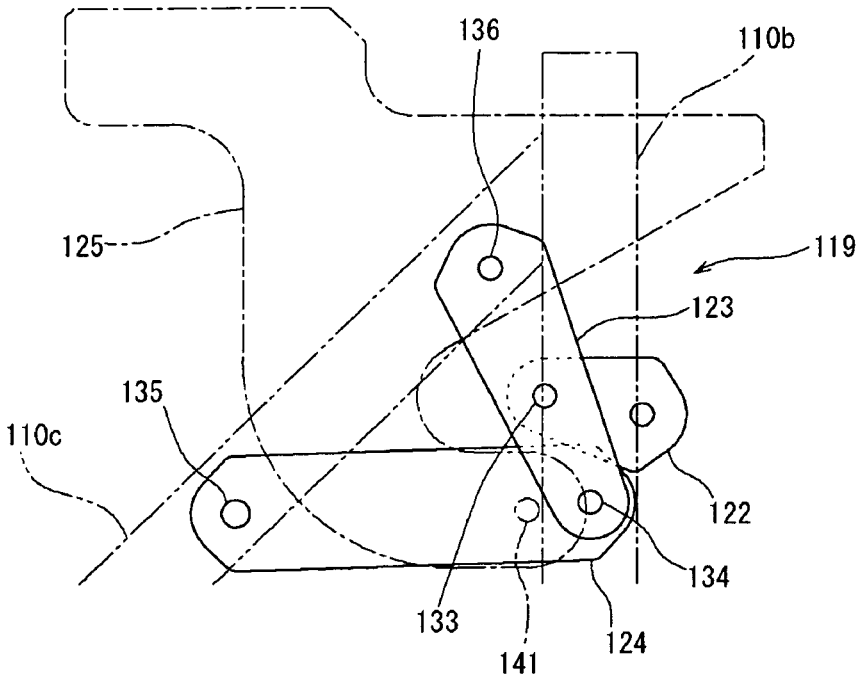
FIG. 22 is an exploded diagram of the link portion.

In FIG. 22, the second link member 122 and the third link member 123 are rotatably connected by the third shaft 133, one end portion of this third link member 123 and one end portion of the fourth link member 124 are rotatably connected by the fourth shaft 134, and the other end portion of this fourth link member 124 is rotatably connected to the second frame 110*c* of the fixed frame 110 by the fifth shaft 135. In addition, the other end portion of the third link member 123 is rotatably connected to the other end portion of the fifth link member 125 by the sixth shaft 136.

Figure 23:
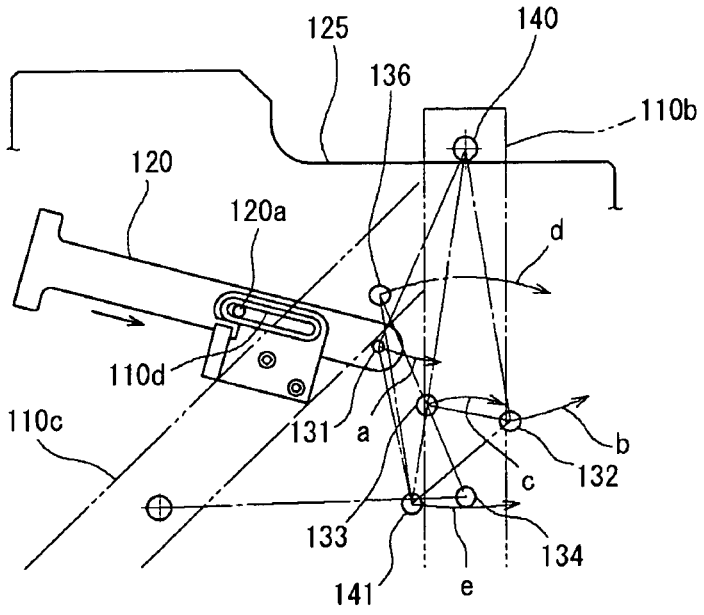
FIG. 23 is an explanatory diagram of the operation of the link portion.
Figure 24:
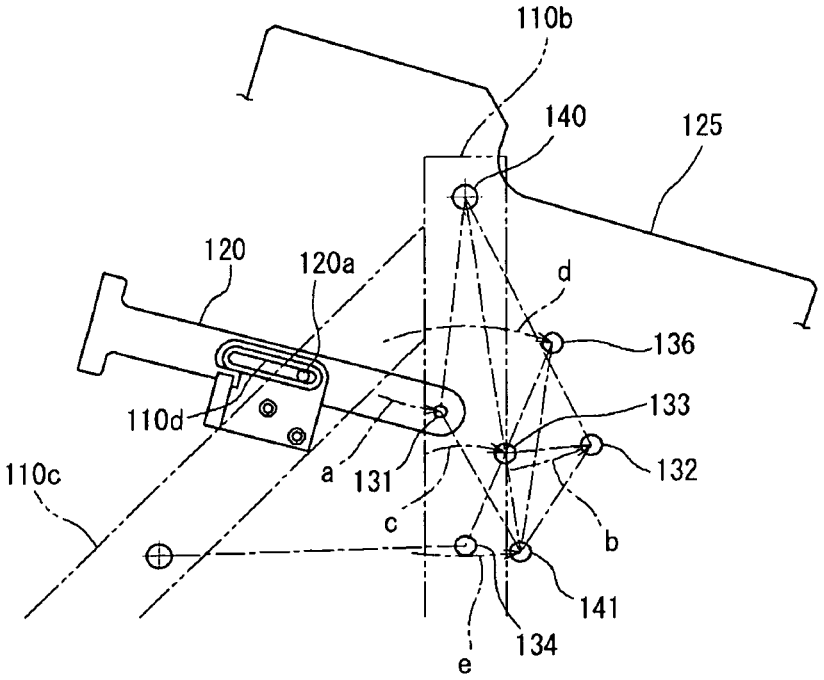
FIG. 24 is an explanatory diagram of the operation of the link portion.

FIGS. 23 and 24 are explanatory diagrams of the operation of the link portion 119. FIG. 23 shows a state of FIG. 17, and FIG. 24 shows the state of FIG. 18. Although FIGS. 23 and 24 show a part of the drive member 120 and the fifth link member 125, other link members are omitted. Moreover, FIGS. 23 and 24 show the shafts for connecting the respective link members and the tracks of the displacing shafts.

When the drive member 120 moves backward, and the first shaft 131 moves backward (arrow a), the second shaft 132 and the third shaft 133 in the first link member 121 move backward (arrows b and c). Then, while the movement of the fourth shaft 134 in the third link member 123 is regulated by the fourth link member 124, the sixth shaft 136 in the third link member 123 moves backward (arrow d), and the fifth link member 125 connected by the sixth shaft 136 is caused to be displaced backward.

During this operation, the first link member 121 displaces the fifth link member 125 backward (arrow e) by the shaft (eighth shaft) 141. Comparing this shaft (eighth shaft) 141, to which the fifth link member 125 is connected, with the sixth shaft 136, the amounts of movement in the front-back direction are different (arrows e and d). Accordingly, the fifth link member 125 retreats backward so as to be inclined downward as shown in FIG. 24.

In the opposite manner to this operation, when the drive member 120 (first shaft 131) is moved forward, the fifth link member 125 can be moved forward (the state shown in FIG. 23).

As described above, it is possible to swing the seat portion 101 fixed to the fifth link member 125 and the backrest portion 102 connected to the seat portion 101 via the frame 101*a* in the front-back direction as a result of swinging the fifth link member 125 along a prescribed track in the front-back direction by repeatedly performing the reciprocating drive of the drive member 120 in the front-back direction.

According to the link portion 119, it is possible to increase the distance of swinging the fifth link member 125 in the front-back direction as shown by arrows d and e in FIGS. 23 and 24 and thereby to provide the user with a comfortable swing.

In this embodiment, the backrest portion 102 is configured to be reclined with respect to the seat portion 101 about the back portion side of the seat portion 101 as the reclining center A11 as shown in FIGS. 17 and 18. That is, the frame 102*a* of the backrest portion 102 is rotatably attached to the frame 101*a* of the seat portion 101 by a shaft. In addition, the drive apparatus 35 (see FIG. 2) for the reclining may be provided in addition to the interlocking member 139 in the same manner as in the respective embodiments. Alternatively, the damper 28 (see FIG. 9) may be provided instead of the drive apparatus 35.

Accordingly, it is possible to perform the rocking operation in which the backrest portion 102 in the reclining state is swung along with the seat portion 101 in the same manner as in the respective embodiments.

As described above, according to the rocking mechanism portion 115 including the link portion 119 and the rocking drive unit 116, it is possible to swing the backrest portion 102 in the reclining state in the front-back direction along with the seat portion 101 while taking a position which is apart or different from the reclining center A11 in the vertical direction as the rocking center A12 in this embodiment as well.

In this fifth embodiment as well, it is possible to provide the reaction member 36 (FIGS. 7A and 7B) and the restraint portion 41 (FIGS. 12A and 12B) in the same manner as in the first embodiment. In addition, since the rocking drive unit 116 includes the air cells 116*a* which are elastically deformable, it is possible to cause the air cells 116*a* to function as a power transmission releasing portion. That is, when the operation of moving the backrest portion 102 and the seat portion 101 in the front-back direction is interrupted, the air cells 116*a* are deformed, whereby it is possible to release the transmission of the drive force, which is for swinging the backrest portion 102 and the seat portion 101 in the front-back direction, to the backrest portion 102 and the seat portion 101.

In addition, if the speed at which the air cells 116*a* expand is controlled by the control apparatus 6, it is possible to provide the same function as that of the speed changing portion.

According to the chair type massage machine of the above-mentioned respective embodiments, it is possible to swing the backrest portion in the front-back direction along with the seat portion while taking a position which is apart or different from the reclining center in the vertical direction as the rocking center. Accordingly, it is possible to swing the user's body in the front-back direction and further to swing the user's body in the front-back direction while allowing the user to keep his or her upper body folded backward since the backrest portion is in the reclining state. As a result, it is possible to enhance the relaxing effect to be provided to the user as compared with the case in the related art.

In addition, it should be considered that the embodiments disclosed herein are just examples in regard to all aspects and the present invention is not intended to be limited thereto. The scope of the present invention is not shown by the above-mentioned meanings but is shown only by the scope of the claims, and the meanings equivalent to the scope of the claims and all the modifications within the scope are intended to be included in the present invention.

For example, different configurations can be employed for the rocking drive unit and the drive apparatus for the reclining drive in the respective embodiments, and configurations other than those shown in the drawings may also be applicable.

In addition, although the description was made of the case in which the treatment elements were the massage tools provided in the backrest portion in the respective embodiments, other configurations are also applicable, and air cells which expand and contract due to the supply and the discharge of air may be employed.

According to the chair type massage machines shown in the fourth embodiment (FIG. 13 and the like) and in the fifth embodiment (FIG. 17), the rocking center A12 is positioned in the upper direction of the seat portion 201. However, the rocking center may be positioned in the lower direction of the seat portion by changing the shape of the guide member.

As another invention which is described just as a reference, a configuration is applicable in which the seat portion and the backrest portion are fixed to have a constant angle. For example, the backrest portion 102 may be fixed to the fifth link member 125 in the fifth embodiment. In such a case, the seat portion 101 and the backrest portion 102 perform the rocking operation with respect to the fixed frame 110 while being maintained in the fixed state.

The preceding description has been presented only to illustrate and describe exemplary embodiments of the present high pressure discharge lamp. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A chair type massage machine, comprising:

a seat portion;

a backrest portion that reclines at a back portion side of the seat portion about a reclining center;

a rocking mechanism portion that swings the backrest portion in a reclining state and the seat portion about a rocking center, which is apart from the reclining center, wherein the rocking mechanism portion comprises a speed changing portion that lowers a swinging speed of the seat portion and the backrest portion as the seat portion and the backrest portion approach front and back track end portions;

wherein the speed changing portion comprises:

a decelerator and a link portion, wherein an output shaft of the decelerator rotates at a constant speed by a constant rotation of a motor, and wherein the link portion converts a rotation movement of the output shaft into a reciprocating movement of the seat portion and the backrest portion and changes the reciprocating movement speed;

a fixed frame;

and a movable frame, wherein the movable frame supports the backrest portion and the seat portion and reciprocates with respect to the fixed frame;

wherein the link portion comprises:

a rotation member that rotates about a rotation center with a rotation of the output shaft, an eccentric shaft attached to the rotation member eccentrically with respect to the rotation center, and a crank member attached to the eccentric shaft, wherein the crank member converts a movement of the eccentric shaft about the rotation center into a reciprocating movement of the movable frame.

2. The chair type massage machine according to claim 1, further comprising:

a power transmission releasing portion that releases a swinging force of the backrest portion and the seat portion to interrupt swinging the backrest portion and the seat portion.

3. The chair type massage machine according to claim 1, further comprising:

a reaction member that produces a force to interrupt swinging the backrest portion and the seat portion.

4. The chair type massage machine according to claim 1, wherein the rocking mechanism portion includes a drive unit that swings the backrest portion and the seat portion.

5. The chair type massage machine according to claim 1, wherein the backrest portion comprises a massage tool.

* * * * *